US006773243B2

(12) United States Patent
Becher

(10) Patent No.: US 6,773,243 B2
(45) Date of Patent: Aug. 10, 2004

(54) ROTARY PISTON MACHINE FOR COMPRESSIBLE MEDIA

(75) Inventor: Ulrich Becher, Porrentruy (CH)

(73) Assignee: Ateliers Busch S.A., Chevenez (CH)

( * ) Notice: Subject to any disclaimer, the term of this patent is extended or adjusted under 35 U.S.C. 154(b) by 0 days.

(21) Appl. No.: 10/469,083

(22) PCT Filed: Feb. 25, 2002

(86) PCT No.: PCT/CH02/00106

§ 371 (c)(1),
(2), (4) Date: Aug. 25, 2003

(87) PCT Pub. No.: WO02/066836

PCT Pub. Date: Aug. 29, 2002

(65) Prior Publication Data

US 2004/0096349 A1 May 20, 2004

(30) Foreign Application Priority Data

Feb. 23, 2001 (CH) ..... 0332/01

(51) Int. Cl.[7] ..... F04C 2/00
(52) U.S. Cl. ..... 418/191; 418/9; 418/200
(58) Field of Search ..... 418/191, 9, 200, 418/201.1, 206.5

(56) References Cited

U.S. PATENT DOCUMENTS 3,472,445 A 10/1969 Brown
3,894,822 A * 7/1975 Abaidullin et al. ..... 418/191
4,324,538 A 4/1982 Brown
4,406,601 A * 9/1983 Towner ..... 418/191

FOREIGN PATENT DOCUMENTS

| | | | | |
|---|---|---|---|---|
| DE | 1503663 A | * | 6/1969 | ..... F04C/18/20 |
| DE | 2944714 A | | 5/1981 | |
| DE | 3323327 C | | 10/1984 | |
| DE | 19537674 C | | 2/1997 | |
| GB | 2073324 A | * | 10/1981 | ..... F04C/18/20 |
| JP | 03067085 A | * | 3/1991 | ..... F04C/18/20 |
| JP | 03149378 A | * | 6/1991 | ..... F04C/2/20 |
| JP | 04350301 A | * | 12/1992 | ..... F01C/1/20 |

* cited by examiner

*Primary Examiner*—Thomas Denion
*Assistant Examiner*—Theresa Trieu
(74) *Attorney, Agent, or Firm*—Clifford W. Browning; Woodard, Emhardt, Moriarty, McNett & Henry LLP

(57) ABSTRACT

Rotary piston machine for compressible media, with rotary pistons sealed tight in a common housing and rotatable with one another in a controlled manner, the rotary pistons having a plurality of disk-shaped sections engaging in one another in pairs, whose thickness and/or diameter decreases in the direction of the pressure side, each disk having a surface area and a core area connected respectively by an interface area, the sector angles of the surface area and of the core area of a respective disk not being identical, the disks having various transverse profile contours periodically recurring along the piston axes and each disk being offset at an angle to the two adjacent disks of the same rotor in a such a way that these three disks have a common area section and form a chamber.

19 Claims, 20 Drawing Sheets

ROTARY PISTON MACHINE FOR COMPRESSIBLE MEDIA

BACKGROUND OF THE INVENTION

This invention relates to a rotary piston machine for compressible media with at least two rotary pistons sealed in a common housing and rotatable in a controlled manner with one another, the rotary pistons having a plurality of disk-shaped sections engaging in one another by pairs and whose thickness reduces in the direction of the pressure side, each disk having at least one surface area and one core area formed by directrices along arcs of circles with centre on the axis of the respective rotary piston and connected by an interface area respectively.

FIELD OF THE INVENTION

Rotary pistons for vacuum pumps or displacement pumps for gases are usually manufactured in the form of screw spindle pairs. For the purpose of displacement or compression these screw spindles have a variable pitch. Screw compressors for gases with two screws engaging in each other and whose pitch reduces constantly towards the pressure side are known. Although such compressors enable high compression ratios to be achieved, the manufacture of screw spindle pairs with variable pitch axes is technically difficult, especially as the screws should engage in each other free from play as far as possible in order to keep pressure losses low. This means that the manufacture of this type of screw compressor is expensive.

On the other hand so-called Roots blowers are known with two disk-shaped rotary pistons engaged in one another. The air throughput occurs diametrically opposed to the rotation axes of the rotary pistons, so that such compressors are suitable for large quantities of air but for low compression ratios only. In order to achieve higher compression ratios several compressor units of this type have to be connected in series, or assembled to form a multi-stage Roots pump.

In order to avoid the difficult manufacture of screw spindles with variable pitch, the suggestion has already been made to develop the rotary pistons as diminishing-step rotary pistons.

DESCRIPTION OF RELATED ART

DE-2934065 discloses such diminishing-step rotary pistons in a rotary piston machine of the type mentioned at the start of the text. In this machine the spindles have a pseudo-thread-like groove formed by graduated recesses provided with peripheries at right angles to the spindle axes and following one another in the screw line. In this groove engages, in the plane delineated by the two spindle axes, a correspondingly formed thread-type comb in the counter spindle and delineates a groove volume with each turn, so that as the spindles roll off one another the comb displaces the groove volumes with compressible medium from inlet to outlet, the groove volumes changing and the desired pressure difference between inlet and outlet being achieved. In their cross-sections the spindles have a semi-circular contour with a cutout delineated by the core area and two step-forming interface areas. The sector angles of the external surface areas and inner core areas have the same value, namely 180°. The disadvantage with this rotary piston machine is the large number of step-shaped peripheries which are necessary in order to form the pseudo-thread-like groove, whose manufacture requires a large number of machining processes. A further disadvantage is the high degree of interface precision required to minimise pressure losses from stage to stage.

A simplified construction of diminishing-step rotary piston is disclosed in DE-2944714. This prior printed publication suggests a laminated construction of rotary pistons with each rotor comprising a plurality of single disks with identical face profile, namely with surface areas and core areas with 180° sector angles each, but with varying thicknesses or diameter. The absent sealing effect between rotary pistons of this construction, which creates gas backflow and a low compression ratio, ought to be compensated for by high-speed operation, but this in turn creates thermal and mechanical problems as well as high noise levels.

The prior printed publication AT-261792 also describes a rotary piston machine of this type in which the diminishing-step rotary pistons comprise single disks with identical cross sections. Each disk has two external surface areas diametrically opposed to one another and two internal core areas diametrically opposed to each other whose sector angles are all the same (90°). With this design of disk and this offset arrangement in the rotor the gap widths between opposing disks must be kept as low as possible. The surface and core areas are therefore connected by interfaces developed as extended epicycloids in order to create the sealing effect between the disks. Consequently both their profile and the external synchronising device of the machine must be very precisely—and therefore expensively—manufactured. Although this prior printed publication provides for the reduction of the thermal loading of the edge tips by means of a rounded shape, these cannot be avoided with gas backflow.

This invention relates to the manufacture of a rotary piston machine with high compression ratio, in particular of a vacuum pump, in which the end vacuum is designed to be better than with rotary vane pumps, approximately similar to that of multi-stage Roots pumps. In doing so, manufacture should be less costly than that of multi-stage pumps and also less expensive than that of screw pumps. Furthermore, internal compression of the compressible medium or gas is meant to occur in order to achieve a reduction in energy consumption and operating temperature. Finally, noise levels during operation should be as low as possible.

SUMMARY OF THE INVENTION

These objects are achieved in a rotary piston machine of the type initially cited, in which the sector angles of the surface area and of the core area of a respective disk are not identical, the disks have various transverse profile contours periodically recurrent along the piston shaft, and each disk is offset at an angle to the two adjacent disks of the same rotary piston in such a way that these three disks have a common directrix via one section of their core areas and form a chamber.

With this type of construction a graduated spiral pitch with horizontal intermediate sections between two chambers is formed in the individual non-assembled rotary piston. A chamber sequence is formed in the axial direction with selectably variable volume, i.e. selectably variable internal compression through selectable thickness variation on the disk-shaped sections.

The use of sequences of disk-shaped sections of various transverse profile contours means that, with a specified number of chambers, the overall number of sections can be kept lower than is the case with the rotary piston machines with state-of-the-art diminishing-step pistons.

With a low number of sections each rotary piston can be manufactured in one piece which substantially improves dimensional stability and is less thermally critical than a stack of single disks. If the operating temperature of the rotary piston machine is low due to the way it is used, the rotary pistons can also be made up of sequences of single profile disks arranged axially one on top of the other, which saves manufacturing costs.

In the following specification the word "disk", unless otherwise specified, is used for both individual profile disks as well as disk-shaped sections of a one-piece piston.

The displacement machine according to the invention is contactless and constantly rotating. The gaps between the two rotary pistons rotating with one another can be subdivided into three types a. Surface area/core area of opposing disk-shaped sections: these linear gaps are determined by the precision of manufacture of the cylindrical areas of the pistons and the distance between the two rotating axes. Low gap values can be achieved with current manufacturing technology.

b. Frontal area/frontal area of disk-shaped sections lying one on top of the other: the gap widths of these flat gaps can also be kept low using modern production machines. The large gap lengths, along the direction of flow between the rotary pistons, effect a good seal and therefore a good end vacuum.

c. Interface area/interface area of opposing sections, in particular tips/concave flank: with the offsetting according to the invention of the disk-shaped sections these gap widths are not critical and can lie within the millimetre range which facilitates substantially the manufacture of the interfaces. As these gap widths also determine the permissible angle play between the rotary pistons, this permissible angle play is very large, which means that the requirements for the synchronising device of the rotary piston machine are reduced and their selection or realisation rendered simpler.

The theoretical cycloid-shaped curved interface areas, i.e. the parallelepiped areas which connect respectively the surface area and the core area, i.e. external cylinder and core cylinder, of a disk-shaped profile section, when the rotary pistons are rotating in the opposite direction, do not have any critical sealing function essential to operation and therefore describe a theoretical maximum contour. A profile contour of the interface area can be made somewhat smaller or flatter than this theoretical maximum contour and manufactured more easily, for instance a contour without undercut and/or virtually straight, and can therefore be preferred and is very efficient in operation. The permissible angle play in operation is also increased as a result.

For practical purposes both adjacent disks of a disk with an external surface area, whose sector angle is greater than the sector angle of the core area, have external surface areas whose sector angles are less than the sector angles of the core areas.

For practical purposes the difference between the sector angles of the external surface area and of the core area of a disk-shaped section is large. The sector angle of this surface area, for a disk with a small external surface area, is preferably less than 90° and, more preferably still, less than 60°. Such a disk opposes a disk of the other rotary piston, with a sector angle of the external surface area correspondingly larger than 270° respectively greater than 300°.

The chambers of a respective rotary piston are preferably designed in such a way that the interface areas of a disk form, respectively with an interface area of an adjacent disk, a continuous interface area with common directrix.

The synchronising device of the rotary piston machine according to the invention can be selected in such a way that the two extra-axial rotary pistons have a contrarotating direction of rotation. The outer diameters of the rotary pistons, the diameters of the core cylinders and the translation can then be selected in such a way that the pistons roll off each other without sliding, the surface area of a disk-shaped section rolling off the core area of the opposing section. If the number of surface areas and core areas of a disk-shaped section are respectively identical to those of the opposing section of the other rotary piston, then a translation of 1:1 is to be selected. If these numbers vary, however, then the translation must be selected accordingly.

In other embodiments with asymmetrical energy distribution the two extra-axial rotary pistons have the same direction of rotation.

In still other, compact embodiments the two rotary pistons are intra-axial, i.e. are designed as external rotor and internal rotor with an additional G rotor.

In several rotary piston designs the disk-shaped sections of a respective rotary piston have only two alternating face section profile contours.

Moreover, the diameters of the surface/outer cylinders and the core cylinders of extra-axial rotary pistons may be respectively identical, the section of the first piston having the one face section profile contour, whilst the opposing section of the second piston has the other face section profile contour, in a same plane at right angles to the piston axis.

The two rotary pistons can also be designed as main rotor and auxiliary rotor with different diameters and therefore varying shaft outputs—up to 100:0%—which is advantageous for the execution of the synchronising device.

In some such embodiments of the rotary pistons, sequences of sections with various face cut profile contours alternate with circular locking disks, so that a respective piston has sections with three or more different profile contours.

Further features and advantages of the invention will emerge for the person skilled in the art from the description which follows of several preferred embodiments and from the accompanying drawings.

DETAILED DESCRIPTION OF THE INVENTION

Figure 3:
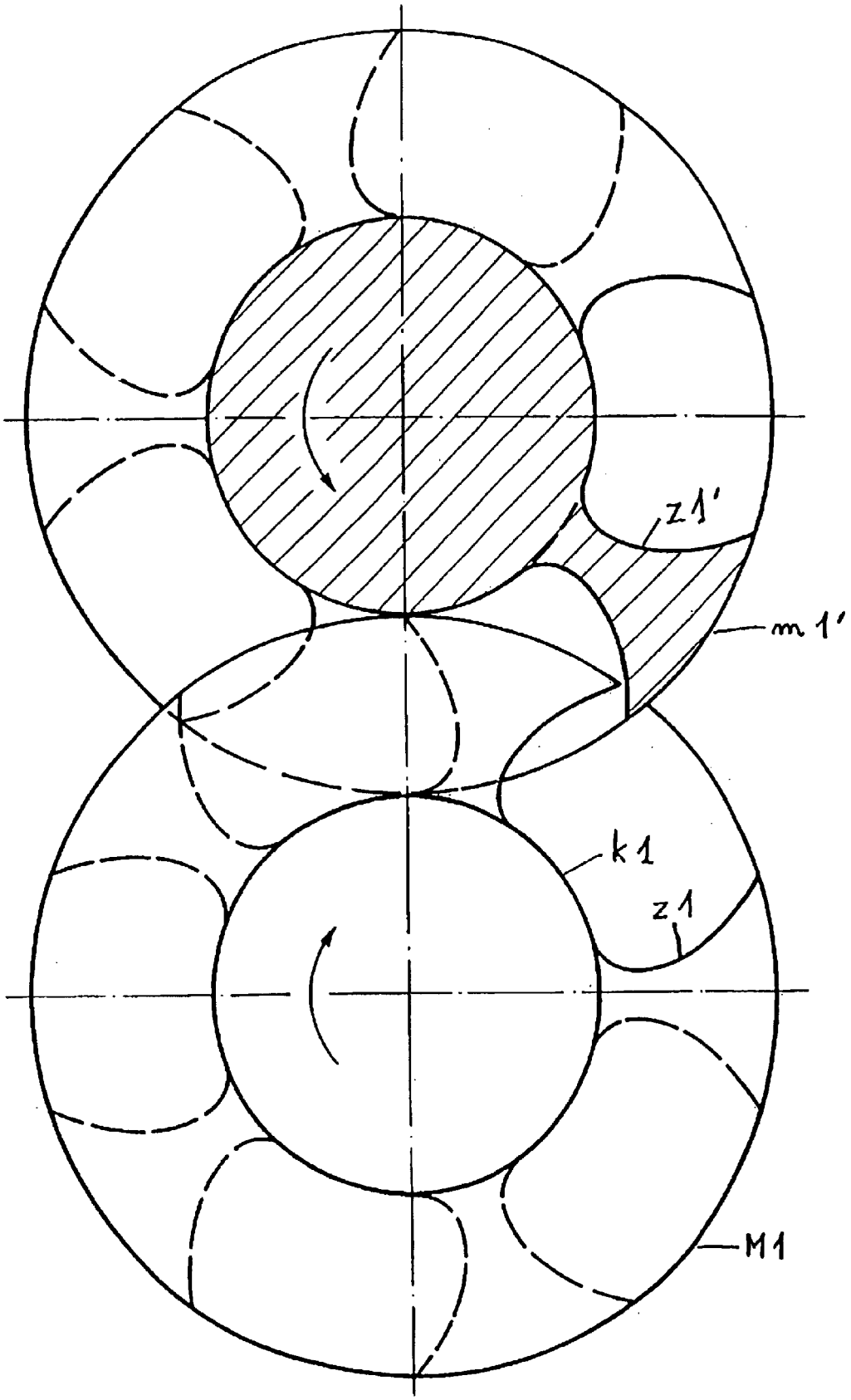
FIG. 3 is a plan view, from the suction side, of the assembled rotary piston of FIGS. 1 and 2, the section "0" of the rotary piston of FIG. 2 having been omitted.
Figure 4:
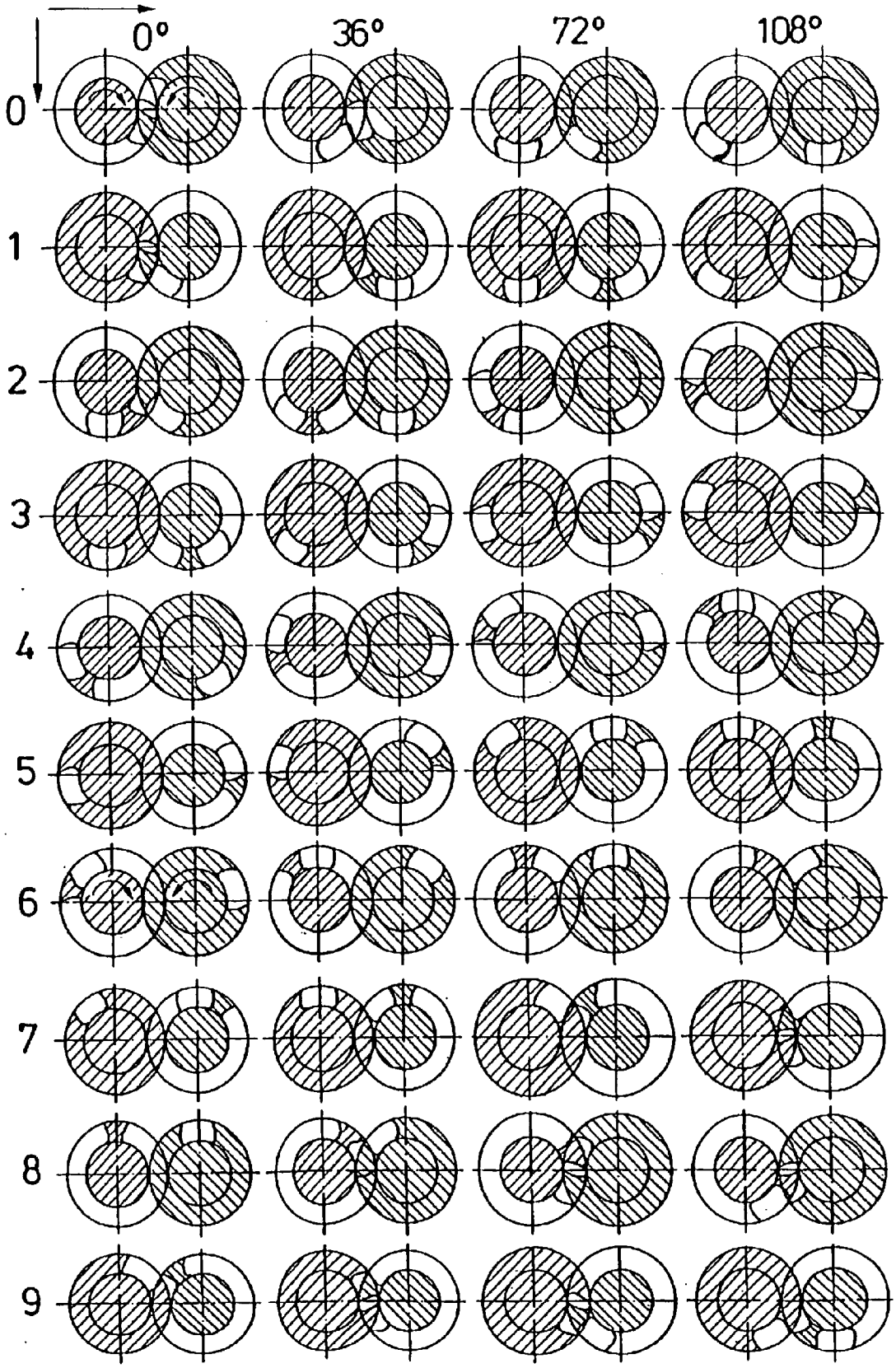
FIG. 4 is a section/flow, i.e. swing angle diagram, which illustrates schematically the functioning of the first embodiment.
Figure 5:
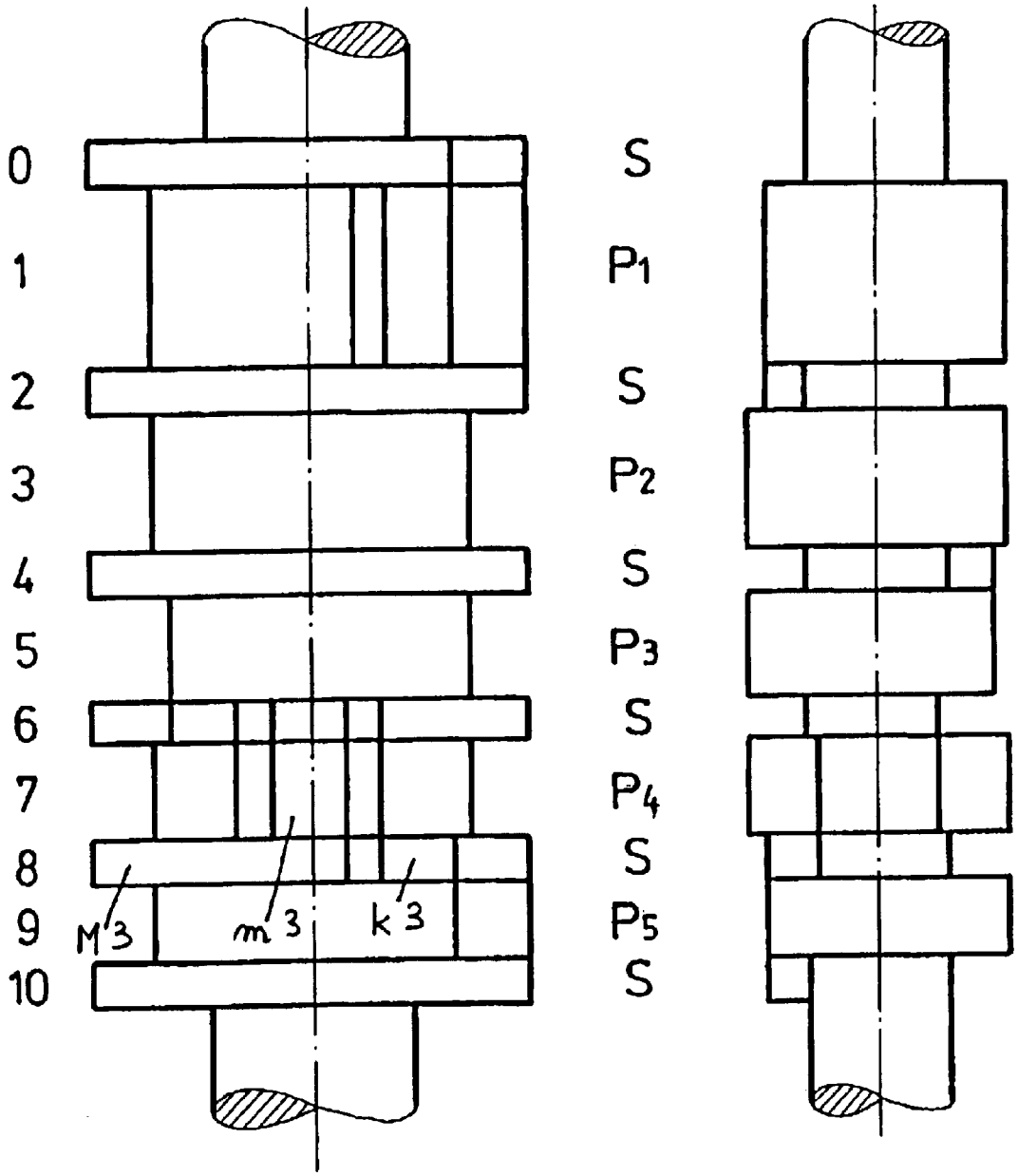
FIG. 5 is a lateral view of a pair of rotary pistons with eleven sections according to a third embodiment, with a main rotor with eleven sections, numbered from 0 to 10.

According to a first embodiment illustrated in FIGS. 1 to 4 the rotary pistons are accommodated extra-axially and parallel-axially in a housing (not shown) with two cylindrical boreholes, with external synchronising device. The rotary pistons have a contrarotating direction of rotation. The rotary pistons have 14 disk-shaped sections, namely two end sections (0, 13) for the medium inlet and outlet, and profile sections (1–12) with two different, alternating profile contours, every one section having an external surface area (m1) with a small sector angle alternating respectively with a section which has a surface area (M1) with large sector angle. In the example embodiment shown these sector angles have values of respectively somewhat less than 36° and somewhat less than 144°, so that an angle play remains intact. FIGS. 3 and 4 illustrate the progressively rotated angle position of one section in relation to the next, i.e. 72° from one section to the identical next-but-one section, an interface area (z1) of a section being arranged respectively above, respectively below, viewed in the axial direction, of an interface area of an adjacent section of the other profile contour. In this way respectively a chamber is formed surrounded (see FIG. 2) by parts of the core areas (k1', K1') and interface areas (z1') of adjacent sections, and so an axial chamber sequence with variable volume, the internal compression being achieved by thickness variation of the profile sections: to realise the internal compression the axial expansion of the sections, and thus the chambers, reduce gradually from inlet to outlet.

The clearance volumes formed between the rotary pistons are of little consequence, whereas the large gap depths between the rotary pistons create a very good end vacuum. As FIGS. 1 to 4 show, there are three types of gap between the rotary pistons.

a. Cylinder/cylinder;

b. Transverse area/transverse area;

c. Tips/concave flank.

The latter type of gap determines the permissible angle play and is not critical, i.e. can lie within the millimetre range, which opens up many possibilities for realising the synchronising device. With rotary pistons of this embodiment a compression ratio of 1:4 is realised which leads to a distinct saving in energy consumption and heat build-up. The overall number of profile sections is therefore minimised with a specified number of chambers and compression.

Figure 1:
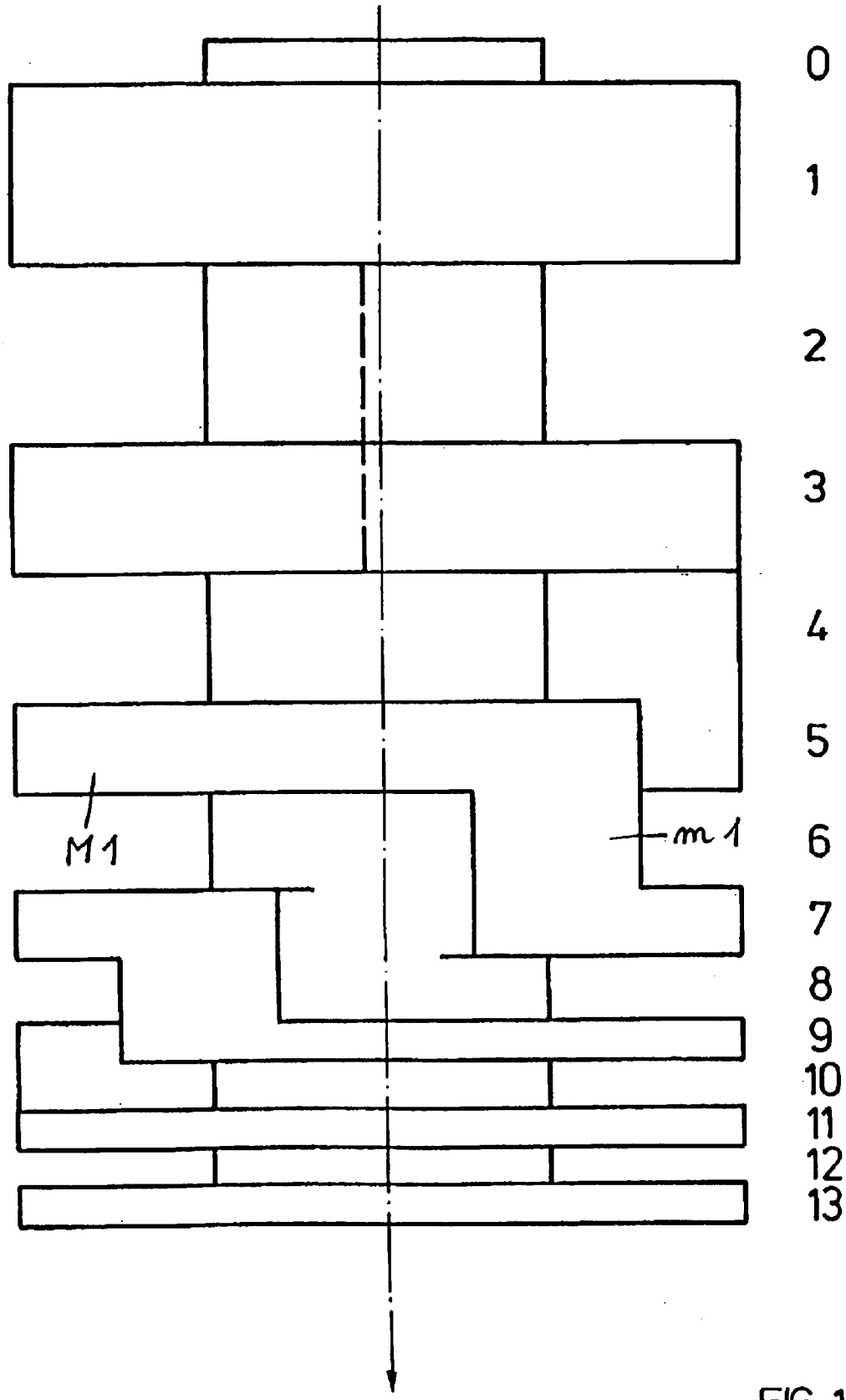
FIG. 1 is a lateral view of a first embodiment of a rotary piston according to the invention, with 14 superimposed disks, numbered from 0 to 13.
Figure 2:
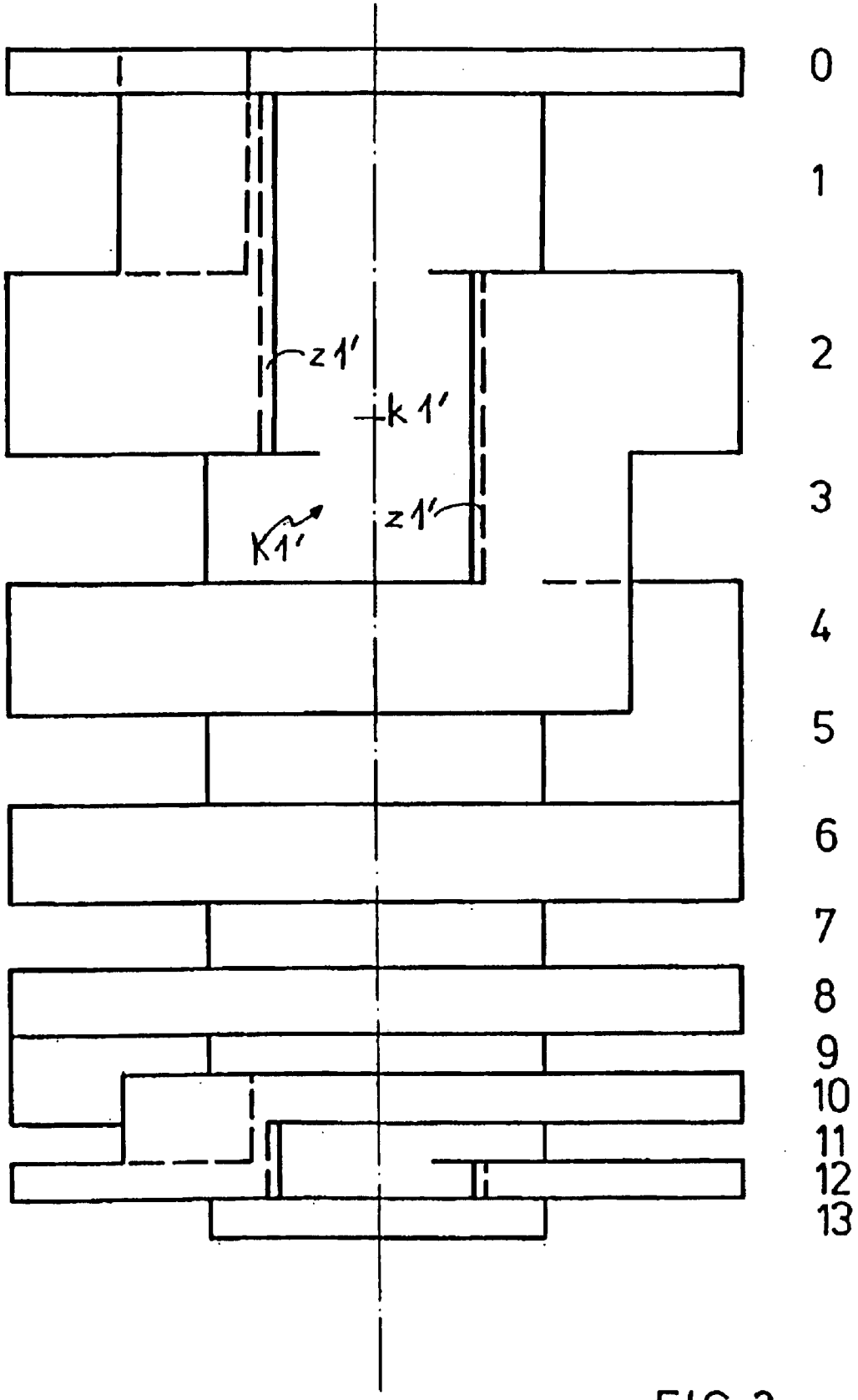
FIG. 2 is a lateral view of the corresponding second rotary piston of the first embodiment.

In the example embodiment shown in FIG. 1 sections 1 and 2 have the same thickness. From section 2 to section 3 the thickness reduces by a factor of approximately 1.4; the thicknesses of sections 3 and 4 on the other hand are the same, etc. With this distribution of section thicknesses where two consecutive and opposing sections of the one and the other rotary piston have the same thickness, energy distribution lapses about 50:50% on each rotary piston. The thickness of the sections might reduce also from each section to the next, according to a selectable and geometric rule.

In a second embodiment not shown separately in the figures, the disk-shaped sections of the two rotary pistons have the same transverse section profile contours and the same angle displacements as in FIGS. 3 and 4. The difference with the first embodiments lies in the thickness distribution of the sections. Sections 1, 3 7, etc. are thick sections, the thickness gradually decreasing from the thickest section 1 to the last section on the pressure side. Sections 0, 2, 4, 6 etc. are all thin disks. With this type of construction the one rotary piston adopts the role of a main rotor, whereas the other rotary piston adopts the role of an auxiliary rotor. Energy distribution between main and auxiliary rotor may be displaced by up to approximately 85:15%.

The embodiments shown in FIGS. 5 to 15 are housed extra-axially and parallel-axially in two cylindrical bore holes of a housing (not shown) with external synchronising device. They are asymmetric with widely varying shaft output up to 100:0%. The minimum number of the various profile contours of the piston sections depends on the arrangement of the profile sequences.

Figure 6:
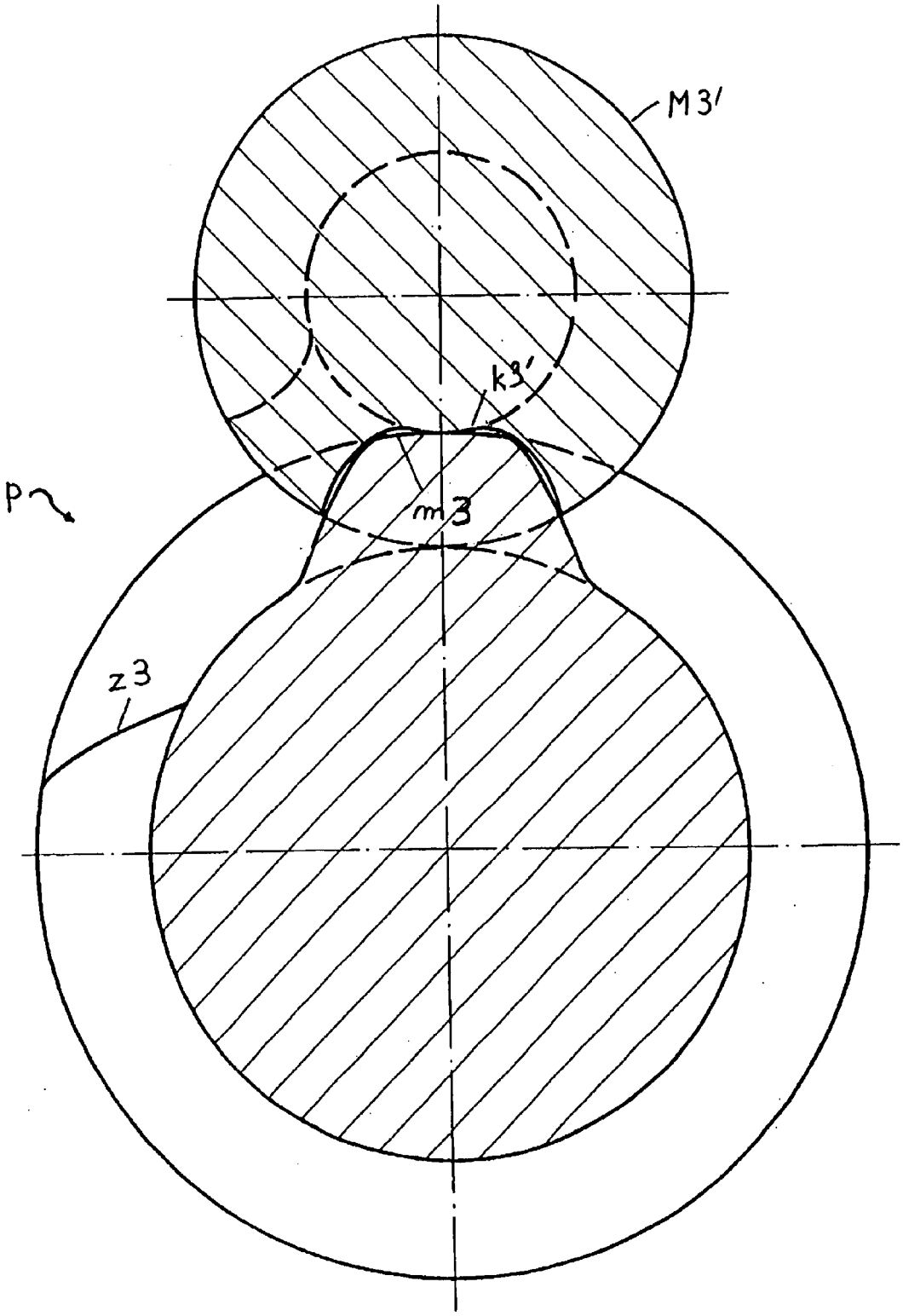
FIG. 6 is a transverse section through section 1 of the assembled rotary piston of FIG. 5.
Figure 7:
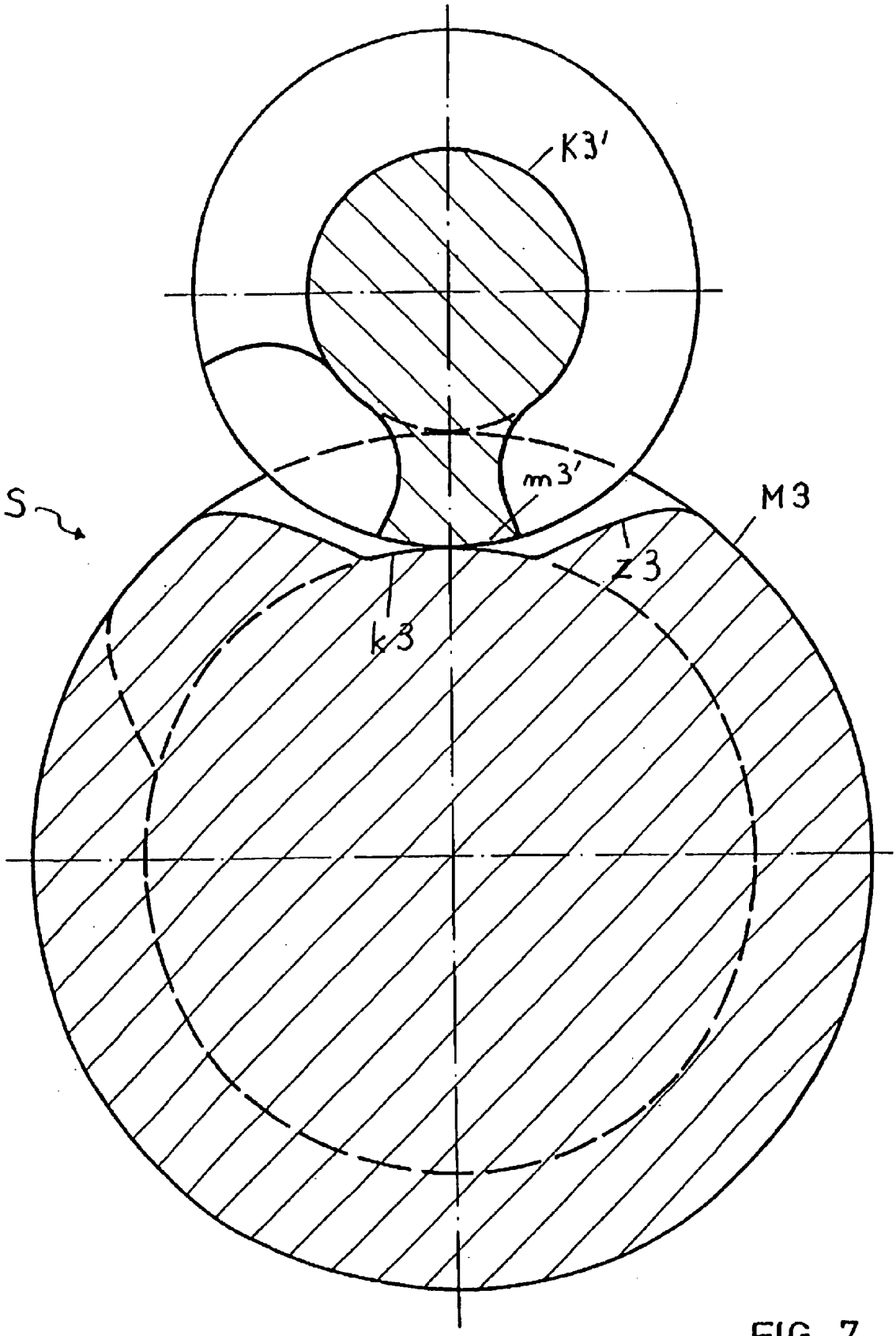
FIG. 7 is a transverse section through a section 2 of FIG. 5.
Figure 8:
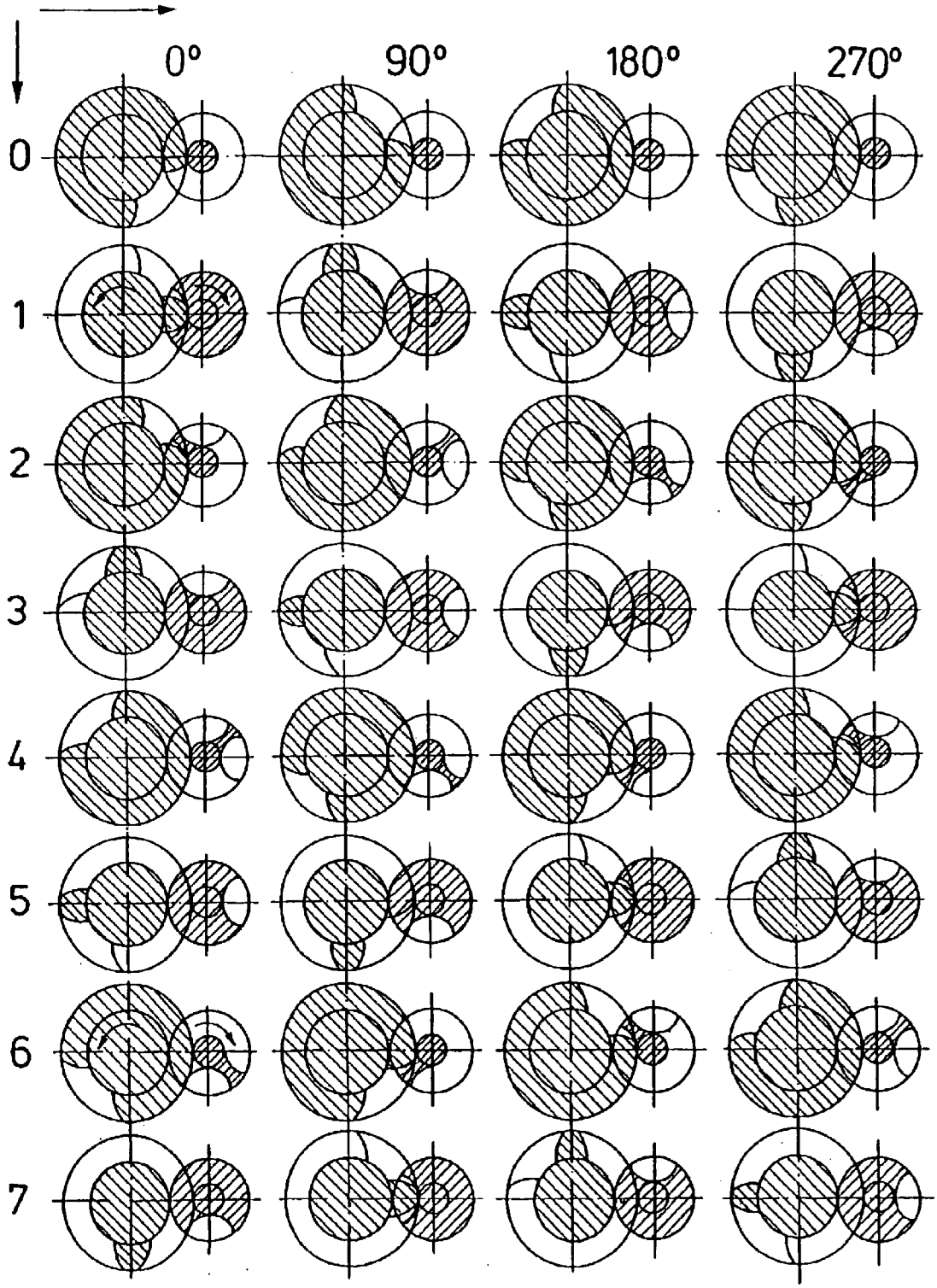
FIG. 8 is a section/swing angle diagram, which illustrates schematically the functioning of the third embodiment.

In a third embodiment shown in FIGS. 5, 6, 7, 8 the diameters of the main rotor and of the auxiliary rotor vary greatly. As can be seen in FIGS. 6 to 8, the main rotor has two alternating and different profile contours, the one profile contour has an external surface area (m3) with a small sector angle, and alternates with a profile contour, whose external surface area (M3) has a large sector angle. The same alternation (m3', M3') applies to the auxiliary rotor. As shown by way of example in FIG. 5 the main rotor has eleven disk-shaped sections. This main rotor has five thick sections 1, 3, 5, 7, 9 whose thickness gradually decreases in the direction of the pressure side and whose external surface area (m3) has a small sector angle. These five sections form pump sections P1–P5. They are separated and surrounded by six sections 0, 2, 4, 6, 8, 10, which have only a short-angled core area cutout (k3), and form each a control section S, which transports the gas to the next pump section.

For example, the thickness of the five pump sections, from P1 to P5, can reduce from approximately 70 millimetres respectively by one third, up to a thickness of 13 millimetres, whereas each control section S has a thickness of 10 millimetres. The overall length of the main rotor then measures approximately 240 millimetres. An example embodiment is shown in the diagram in FIG. 8, where the core diameter of the main rotor is the same as the external diameter of the auxiliary rotor. With a translation of 1:1 the rotors roll off each other without one sliding off over the other. Under these conditions the energy distribution between main and auxiliary rotor is approximately 75:25%.

Figure 9:
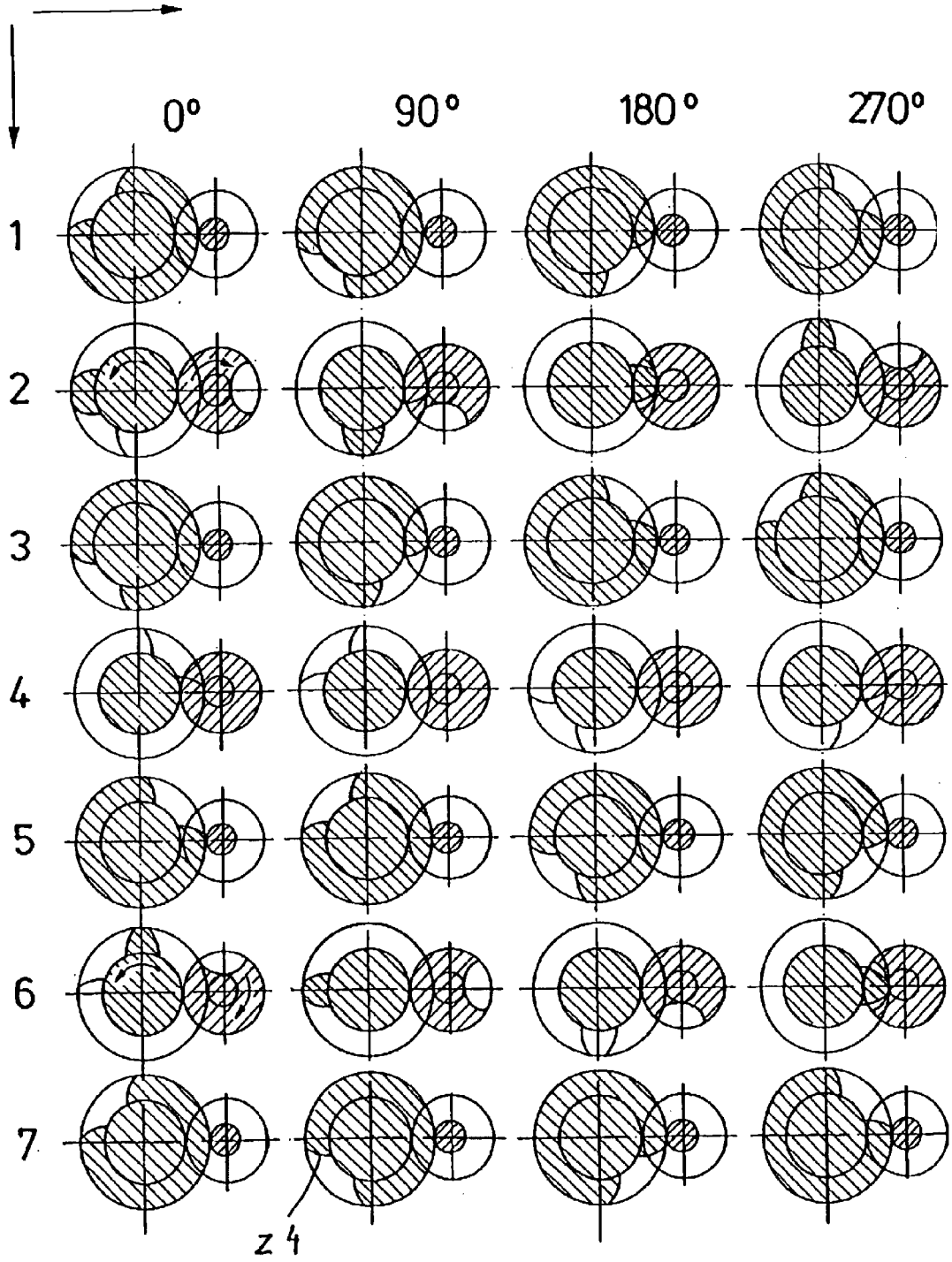
FIG. 9 is a section/swing angle diagram, which illustrates schematically the functioning of a fourth embodiment.

In the fourth embodiment shown in FIG. 9 the diameters of the main rotor and of the auxiliary rotor also vary greatly. The main rotor also has two different, alternating profile contours in the transverse section, similar to the third embodiment. The auxiliary rotor, however, has three different profile contours, namely in the following sequence:

- a section 1 consisting of a simple core disk,
- a section 2 in the form of an external cylinder with a low-angle cutout,
- a section 3 which again consists of a core disk,
- a section 4, which consists of a full external cylinder disk and forms a locking disk.

With this arrangement of main and auxiliary rotor virtually 100% energy is distributed to the main rotor and 0% to the auxiliary rotor.

Figure 10:
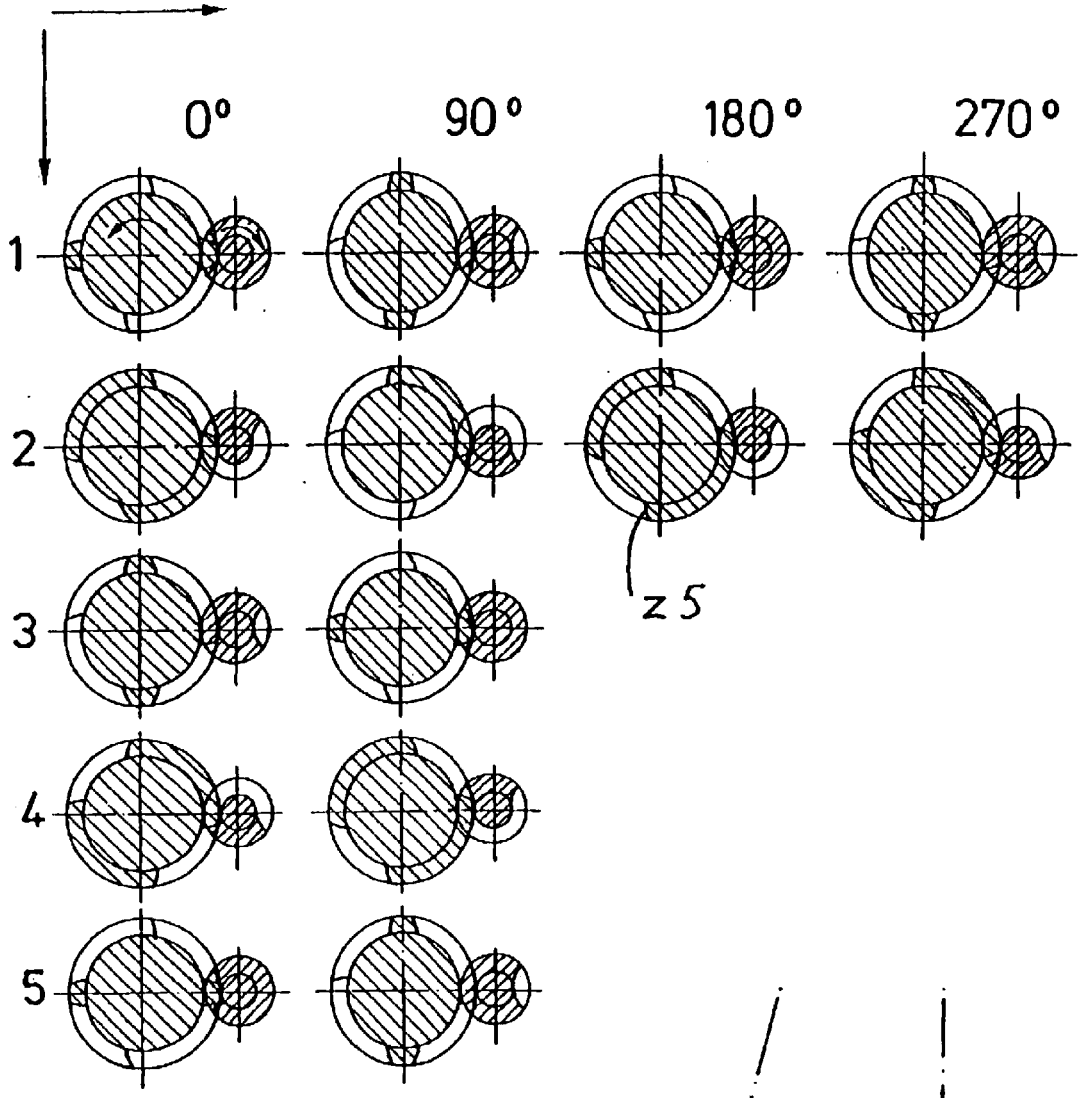
FIG. 10 is a section/swing angle diagram, which illustrates schematically the functioning of a fifth embodiment.

FIG. 10 represents a fifth embodiment in the form of a diagram. The main rotor has two different, alternating transverse profiles each having two identical, external surface areas and two identical core areas respectively diametrically opposed to one another. The relative sector angle dimensions of the surface and core areas vary from section to section as with the previous embodiments. The auxiliary rotor has respectively only one external surface area and one core area, with large and small angles alternately. The synchronising device is developed in such a way that the speed of rotation of the auxiliary rotor is twice the speed of the main rotor. With this construction, a highly asymmetric energy distribution is achieved, namely approximately 85% to the main rotor and approximately 15% to the auxiliary rotor.

The five embodiments described above all have many advantages:

- with a low number of sections a rotary piston can be manufactured as a monobloc, which improves the dimensional stability during operation substantially;
- the large gap lengths along the flow, between the rotary pistons, provide a good seal and therefore a good end vacuum;
- the large permissible play facilitates manufacture and assembly and the use of the synchronising device.

In the third, fourth and fifth embodiment the main rotor interface areas are developed without undercut, which simplifies the number of work sequences during manufacture.

In the asymmetric embodiments power fractions of the driving rotary piston and the driven rotary piston vary greatly, which also offers advantages for the selection and execution of the synchronising device.

With rotary pistons made up of individual profile disks the number of various individual parts is reduced through the use of identical control and locking disks.

A sixth embodiment, whose rotary piston pair is represented in FIGS. 11 to 15, comprises a contactless, parallel-axial, bi-axial, extra-axial, constantly rotating displacement machine, with a housing with two cylindrical boreholes and external synchronising device, the two rotary pistons having the same direction of rotation.

The rotary pistons whose diameters vary greatly are developed as main rotor and auxiliary rotor. Both the main rotor and the auxiliary rotor have at least three different types of profile. In the example embodiment shown in FIGS. 12 to 15 both the main and auxiliary rotor have four different types of profile which form sequences of four different disk-type section pairs, namely

Figure 12:
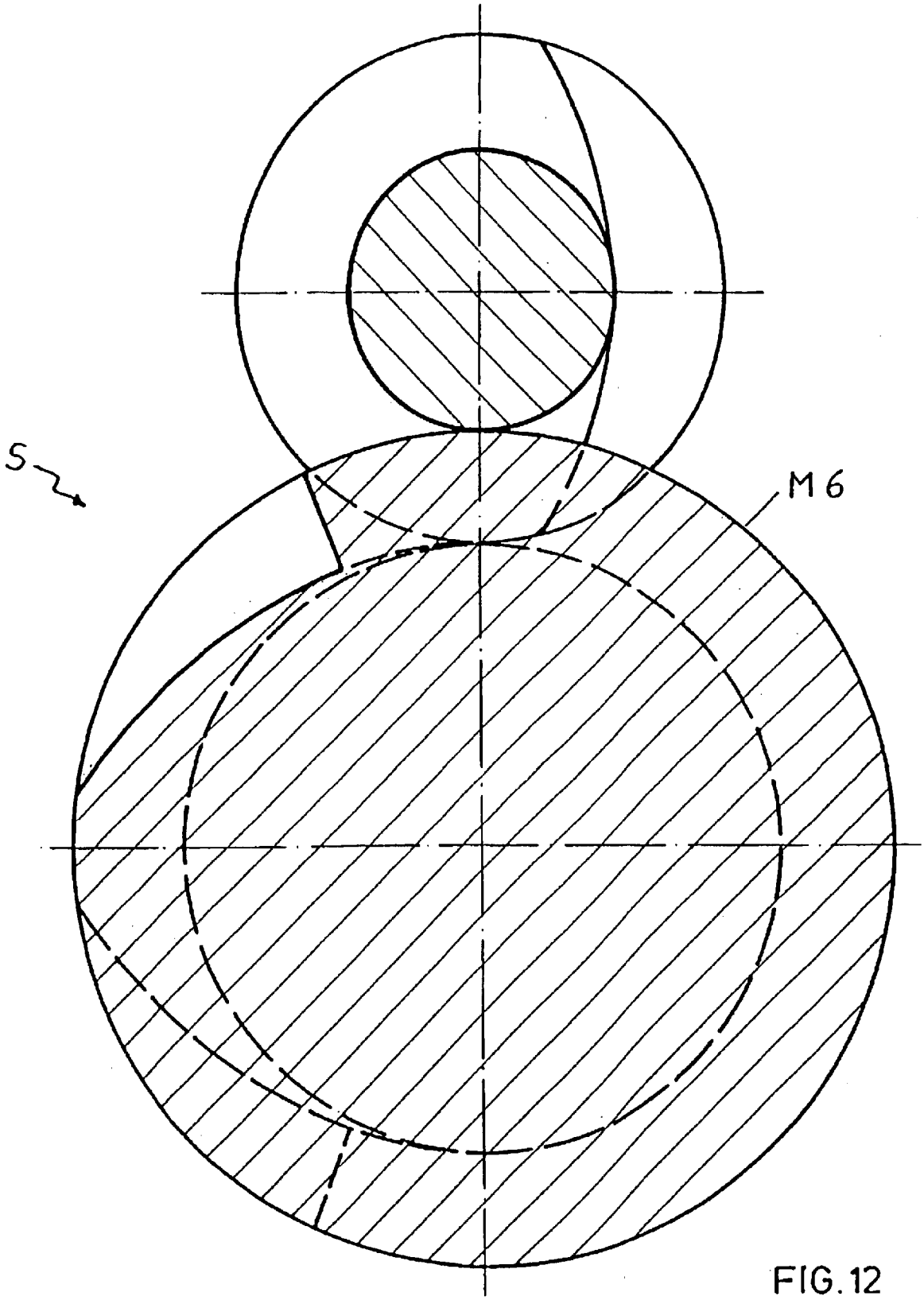
FIG. 12 is a transverse section through section 1 of the assembled rotary pistons of FIG. 11.
Figure 13:
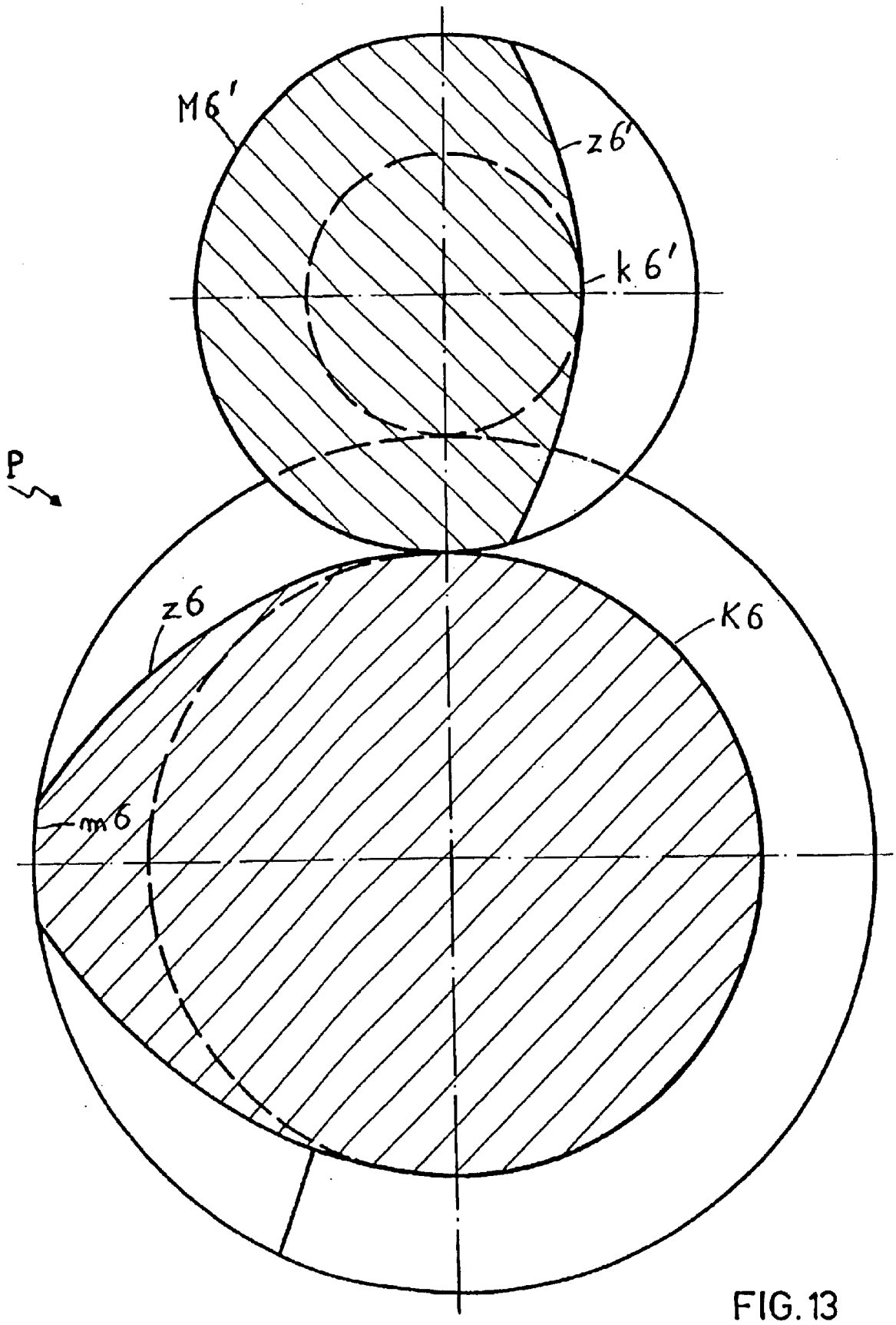
FIG. 13 is a transverse section through section 2 of the assembled rotary pistons of FIG. 11.
Figure 14:
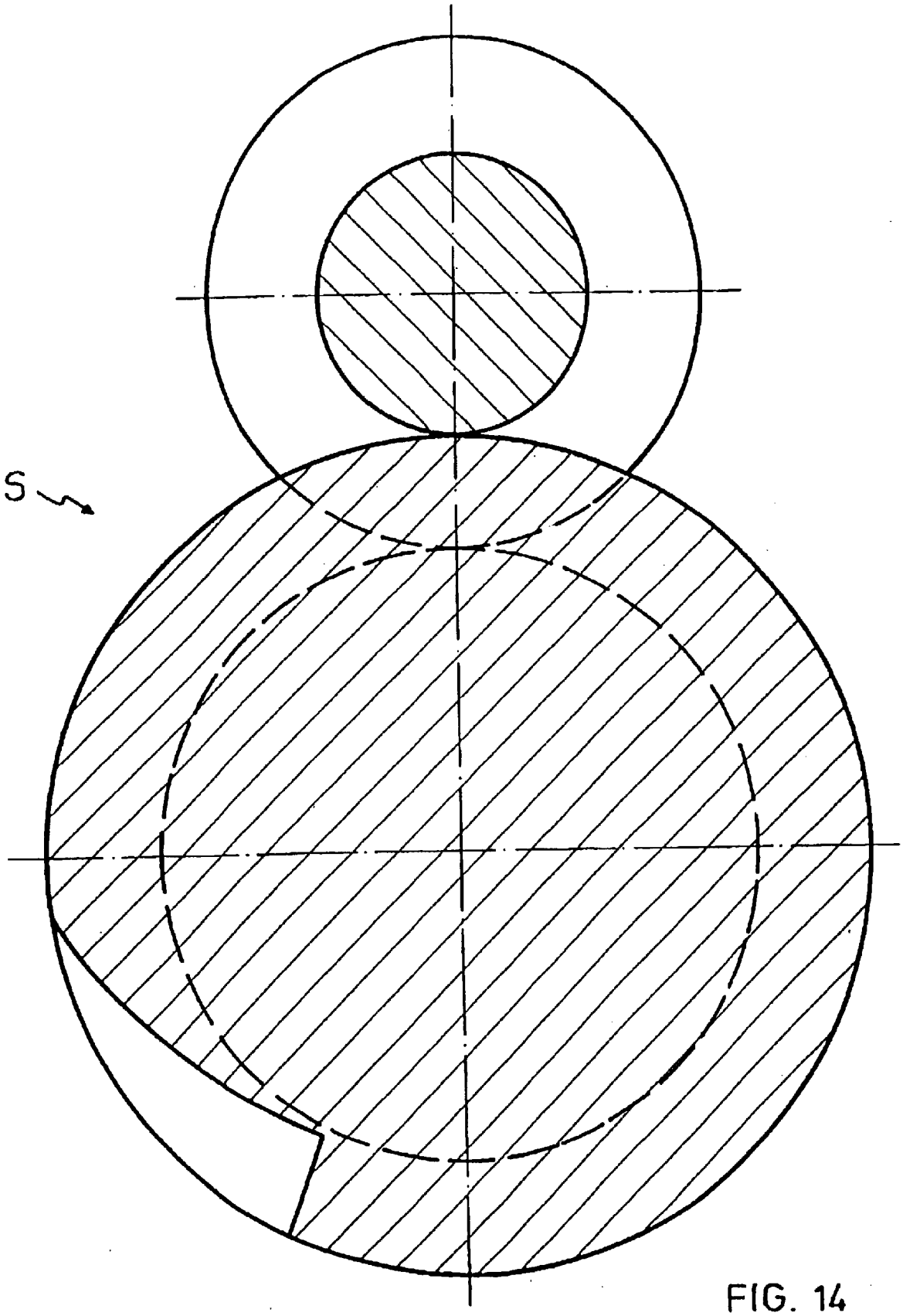
FIG. 14 is a transverse section through section 3 of the assembled rotary pistons of FIG. 11.
Figure 15:
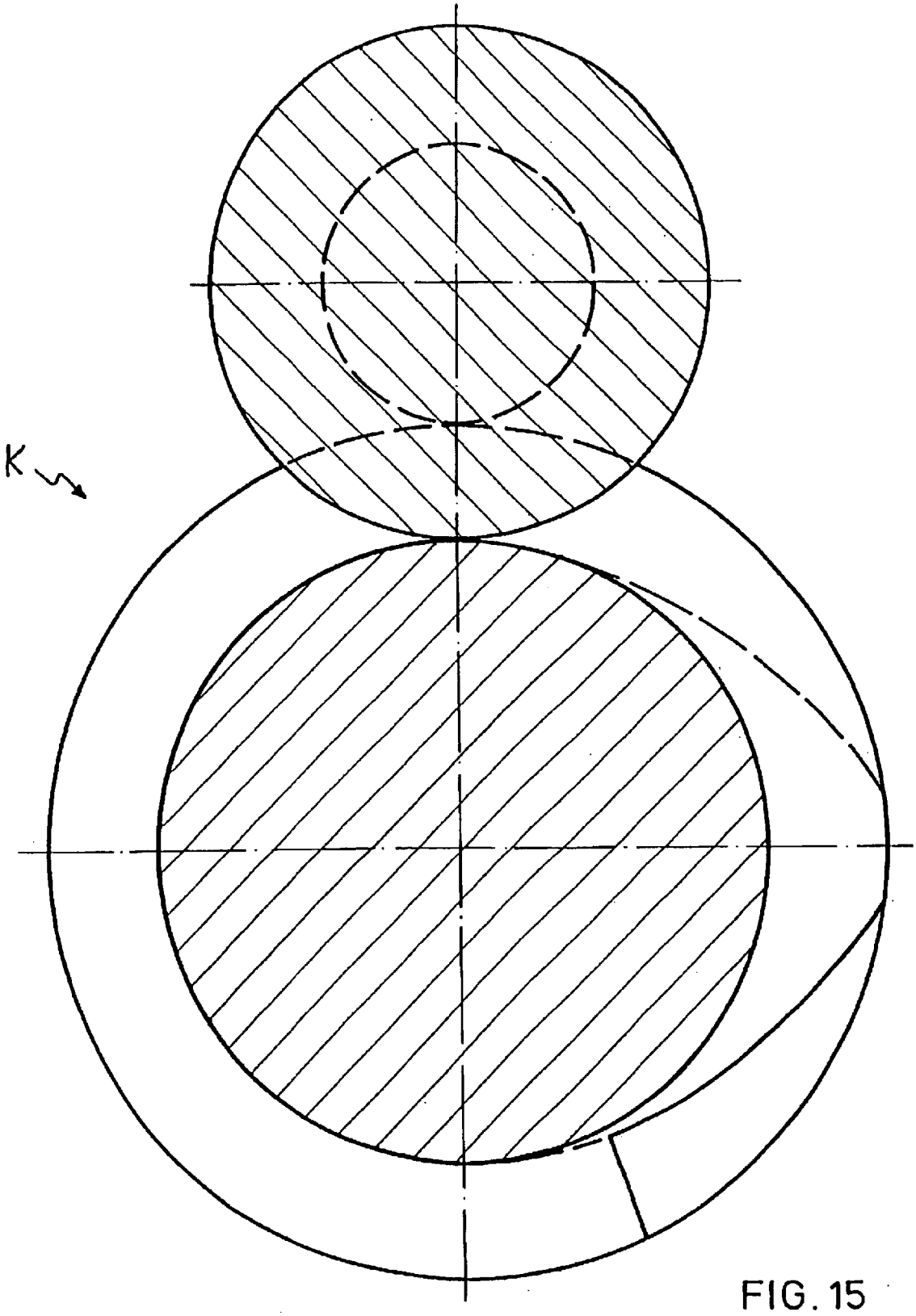
FIG. 15 is a transverse section through section 4 of the assembled rotary piston of FIG. 11.

- an initial section (FIG. 12) in which the main rotor possesses a large-angled surface area (M6); the sector angle of the core area can be kept very low or, as shown in FIG. 12, it can even be dispensed with, so that the external surface area of this section is only interrupted by a sickle-shaped, asymmetrical cutout. This section serves as initial control disk S and is located opposite an initial section of the auxiliary rotor, which simply consists of a core cylinder disk;
- a second section P of the main rotor (FIG. 13) has a core area (K6), whose sector angle is greater than 180°, an extremely short external surface area (m6) and two longish expanded interface areas (z6). Opposite this is a second section of the auxiliary rotor, with an external surface area (M6') whose sector angle is greater than 180°, with a minimal core area (k6') which also, as can be seen in FIG. 13, can disappear completely or virtually completely through continual merging of the two interface areas (z6') at a tangent to the core cylinder. This section forms the actual pump stage of the sequence;
- the third section of the main rotor (FIG. 14) is identical in its form to the first section, but arranged planisymmetrically, as can be seen in FIGS. 12 and 14. The opposite third section of the auxiliary rotor is formed as a simple core cylinder disk;
- the fourth section (FIG. 15) of the main rotor is a simple core disk and serves as channel K for the compressible medium. Opposite this is a fourth section of the auxiliary rotor with an uninterrupted, external surface area which serves as a locking disk.

Figure 11:
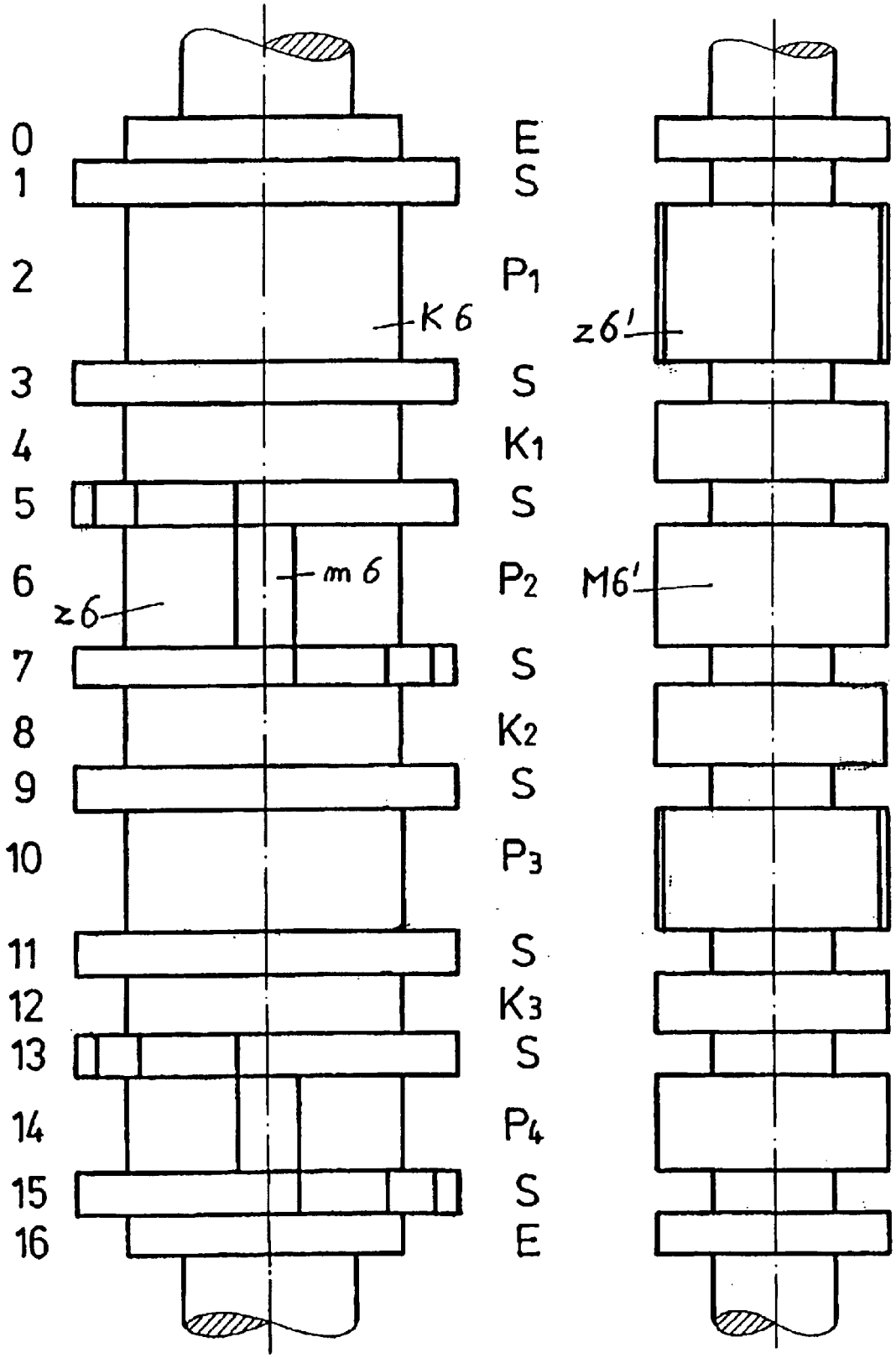
FIG. 11 is a lateral view of a pair of rotary pistons according to a sixth embodiment, with 17 sections, numbered from 0 to 16.

FIG. 11 shows the full construction of an example embodiment with 17 disk-shaped sections, namely two end disks (E), 0 and 16; three full sequences S-P-S-K, of the four sections just described, 1 to 4, 5 to 8, 9 to 12; and an incomplete sequence, S-P-S, i.e. with an initial control disk 13, a pump stage 14 and a second control disk 15.

The control disks S of the main rotor can all be made up of thin disks, as they only serve to pass the medium from a pump stage P into the following channel K and again into the next pump stage. The gradation of the axial expansion of the pump stages and of the channel stages may be subject to various mathematical rules determined by its function. Table 1 shows two gradations as an example, in which the thickness of the thickest stage, namely pump stage 1, was set arbitrarily with 1.

| | Example 1 | Example 2 |
|---|---|---|
| P1 | 1 | 1 |
| K1 | 0.8 | 0.5 |
| P2 | 0.6 | 0.64 |
| K2 | 0.46 | 0.32 |
| P3 | 0.36 | 0.42 |
| K3 | 0.29 | 0.21 |
| P4 | 0.21 | 0.28 |

As can be seen in Example 1, the thickness of the stages reduces progressively in the sequence P1, K1, P2, K2, etc. whereas in Example 2 the thicknesses of the pump stages on the one hand and the channel stages on the other hand decrease, but alternate in their thickness. For a thickness P1=49 mm, for example, and a thickness of control disk of 8 mm, with the gradation of example 2, an overall length of the main rotor of approximately 240 mm results.

Figure 16:
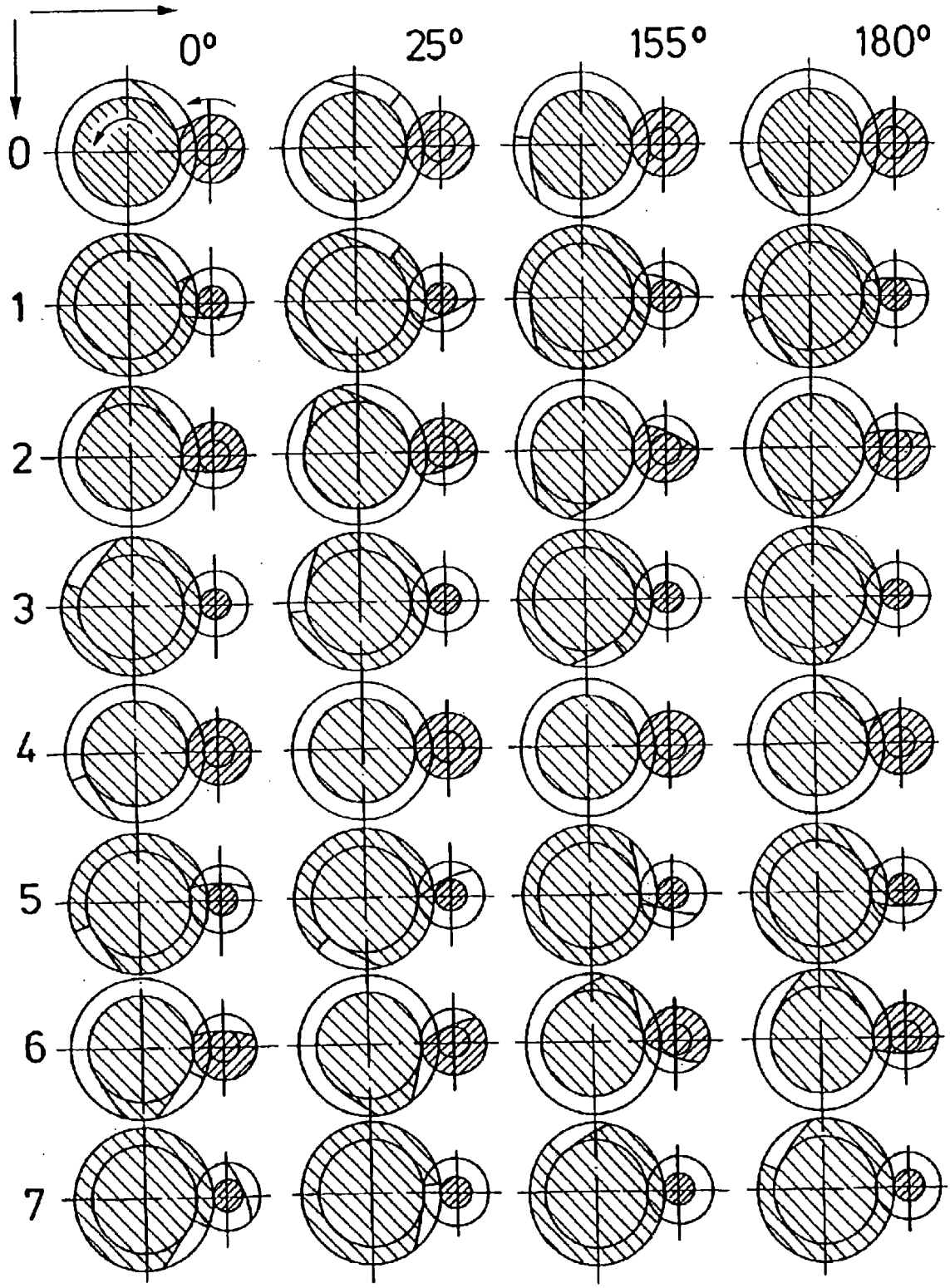
FIG. 16 is a section/flow, i.e. swing angle diagram, which illustrates schematically the functioning of the sixth embodiment.

The functioning of this sixth embodiment emerges from the diagram in FIG. 16. Consequently, an axial chamber sequence is realised in an extra-axial displacement machine with pistons rotating in the same direction. The piston shaft outputs vary greatly, i.e. energy distribution is extremely asymmetrical, up to 100:0%. This embodiment has the following advantages:

- the undercut-free contours permit extremely simple manufacture; monobloc manufacture in particular is easily executed;
- the very large, permissible play is advantageous for manufacture and assembly;
- the large gap lengths along the flow permit a good end vacuum;
- the same direction of rotation and the large permissible play open additional possibilities for the synchronising device; as regards the low power of the auxiliary rotor, toothed belts can even be used.

In the six embodiments described above both rotary pistons are generally cylindrically developed with parallel rotation axes. The directrices, whose course forms the surface areas, core areas and interface areas of the disk-shaped sections are cylindrical directrices, and the generatrices are parallel to the rotation axes. The person skilled in the art will recognise that, when the transverse section contours and angular offsetting of the piston sections according to the invention are used, the rotary piston can also be conically formed, the directrices whose course defines the circumferential areas of the disks, are the directrices of a cone, so that the circumference of the disks are conical, and their diameters decrease gradually in the direction of the pressure side. The rotation axes of the two pistons are then not parallel but have a point of intersection. With these embodiments the variation in diameter creates an internal compression. The variation in diameter can be used in addition to the variation in the thickness of the disks or instead of the variation in the thickness of the disks.

Figure 17:
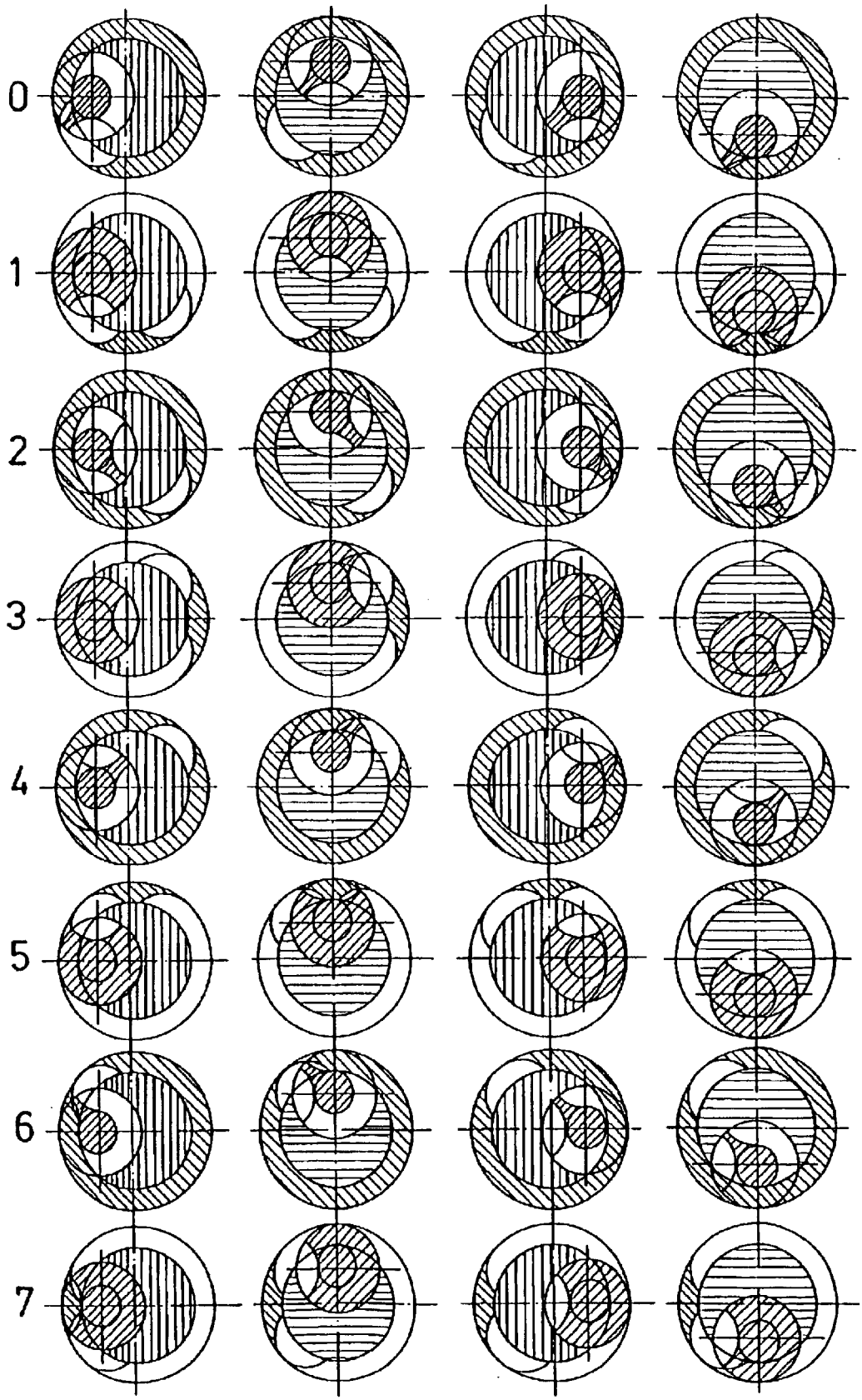
FIG. 17 is a section/flow diagram, which illustrates schematically the first nine sections of a seventh embodiment and their interaction.
Figure 18:
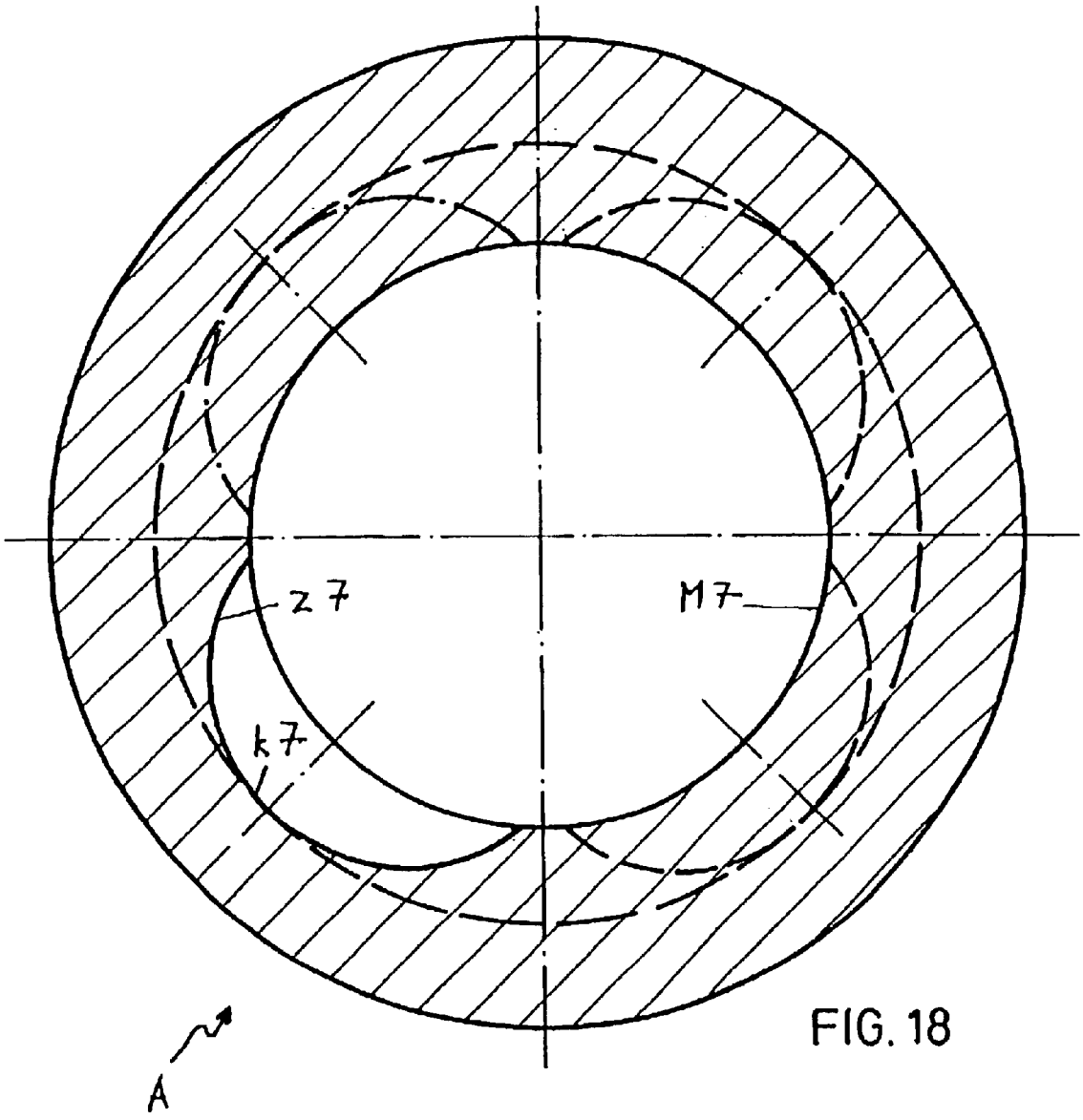
FIG. 18 is a transverse section through section 1 of the outer rotor of the embodiment of FIG. 17.
Figure 19:
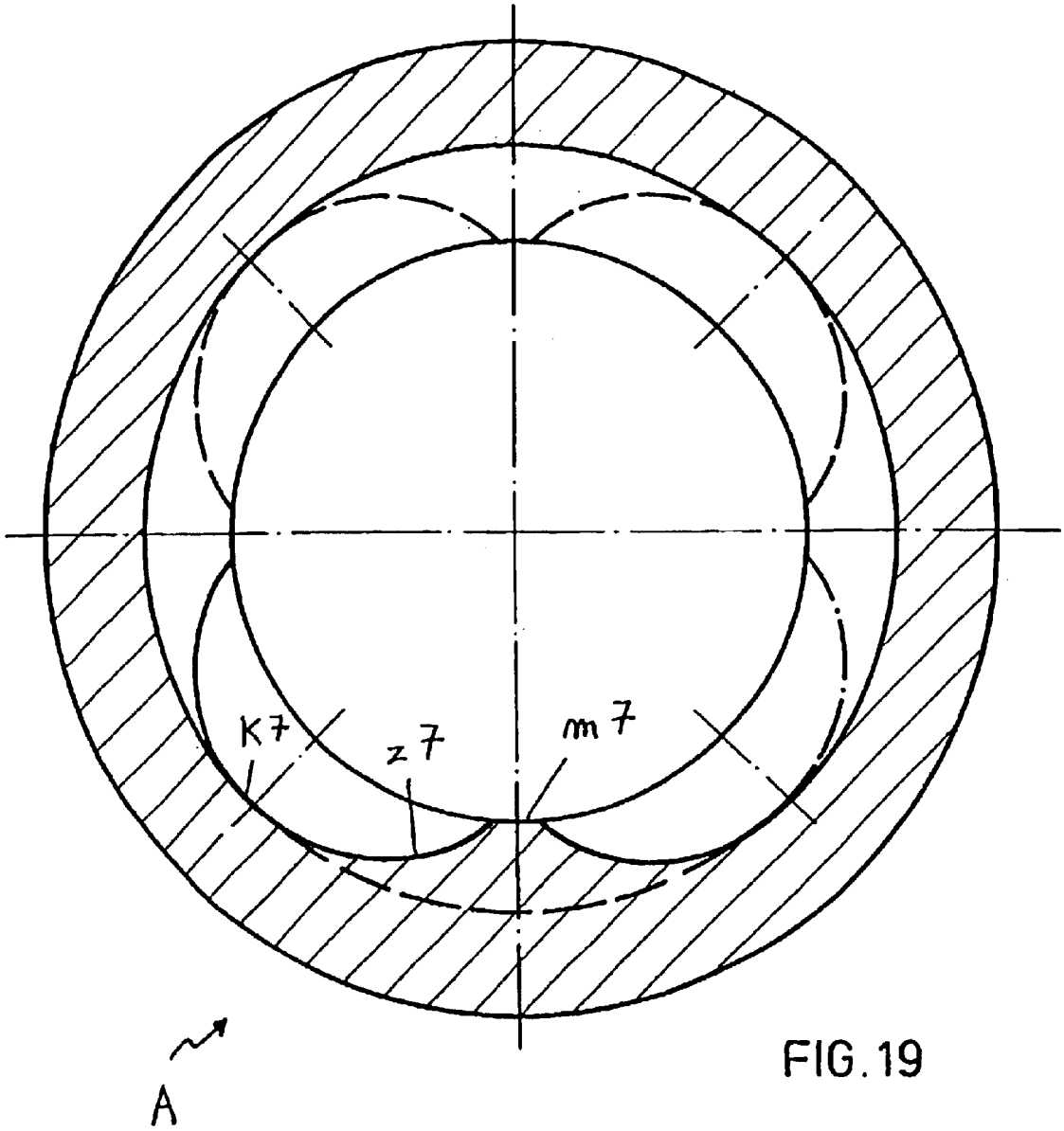
FIG. 19 is a transverse section of section 2 of the outer rotor of the embodiment of FIG. 17.
Figure 20:
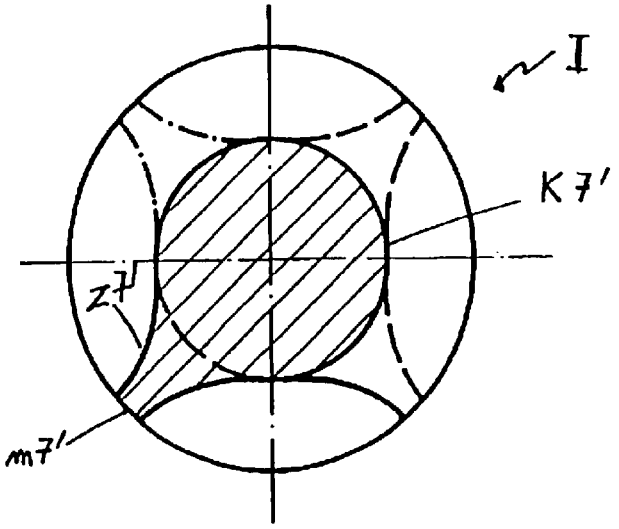
FIG. 20 is a transverse section of section 1 of the internal rotor of the embodiment of FIG. 17.
Figure 21:
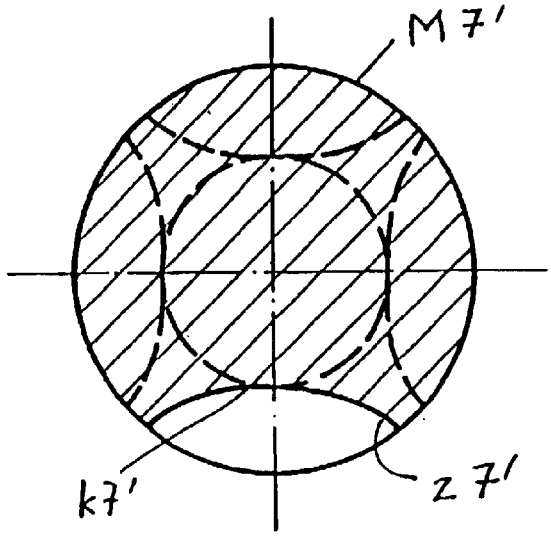
FIG. 21 is a transverse section of section 2 of the internal rotor of the embodiment of FIG. 17.
Figure 22:
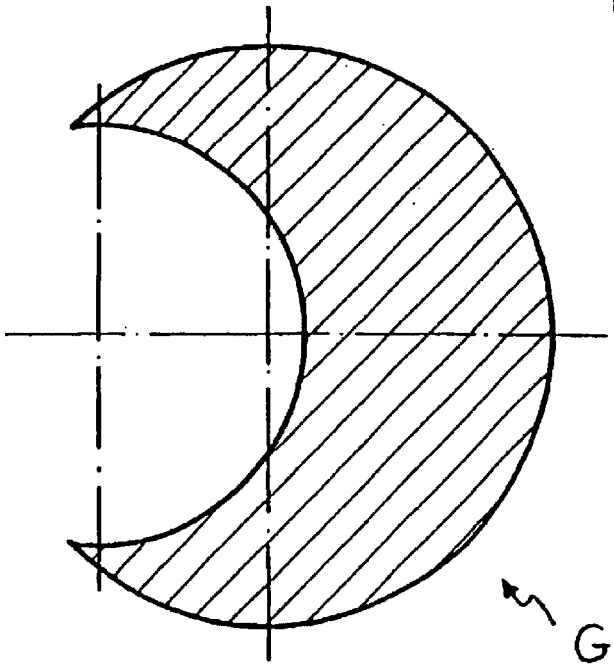
FIG. 22 is a transverse section of the sickle-shaped G rotor of the embodiment of FIG. 17.

FIGS. 17 to 22 represent a seventh embodiment, namely a contactless, parallel-axial, bi-axial, inner-axial, constantly rotating displacement machine. The machine has a hollow external rotor, an internal rotor and a sickle-shaped G rotor between external and internal rotor. The rotors have the same direction of rotation, as shown in FIG. 17. The external rotor (A) and the internal rotor (I) have a plurality of disk-shaped sections that engage in one another in pairs and whose thickness decreases in the direction of the pressure side, each disk having at least one surface area and one core area developed by directrices drawn along arcs of circles with centre on the axis of the respective rotor and connected respectively by an interface area (z7), or (z7'). As FIGS. 17 to 22 show, the disks for the external and internal rotor have two recurrent profile contours recurring periodically along the piston axis, —alternating in this embodiment. The sector angles of the surface area and core area (m7, k7), or (m7, K7), (m7', K7') and (M7', k7') of a respective disk are not identical and each disk is offset in relation to the two adjacent disks of the same rotor in such a way that these three disks have a common directrix via one section of their core areas and interface areas and form a chamber.

This embodiment realises an axial chamber sequence in an inner-axial machine. A synchronising device 1:1 is used. The synchronising device can be arranged inside the external rotor. A simple lubricant-free coupling mechanism can be used for this. This embodiment permits a very compact construction with good heat evacuation and with the same advantages as the extra-axial embodiments described above.

An eighth embodiment also comprises a contactless, two-axis, inner-axial, constantly rotating displacement machine with an external rotor, an internal rotor and a sickle-shaped G rotor between external rotor and internal rotor. The rotors have the same direction of rotation. A translation of 1:1 is used. In contrast to the seventh embodiment the two rotation axes are arranged as oblique axes, so that the diameters of the rotors vary along a conical path.

The outer rotor and the internal rotor have a plurality of sections engaging in one another in pairs which, in contrast to the seventh embodiment described above, are developed not as cylindrical disks with flat transverse areas but as curved sections, namely as ball cup sections.

In a transversal section, the profile contours of two consecutive sections of the external and the internal rotor are similar to those in FIGS. 18 to 22. This means that an axial chamber sequence is realised in an inner-axial, oblique-axial machine whose rotors rotate with a translation of 1:1.

Figure 23:
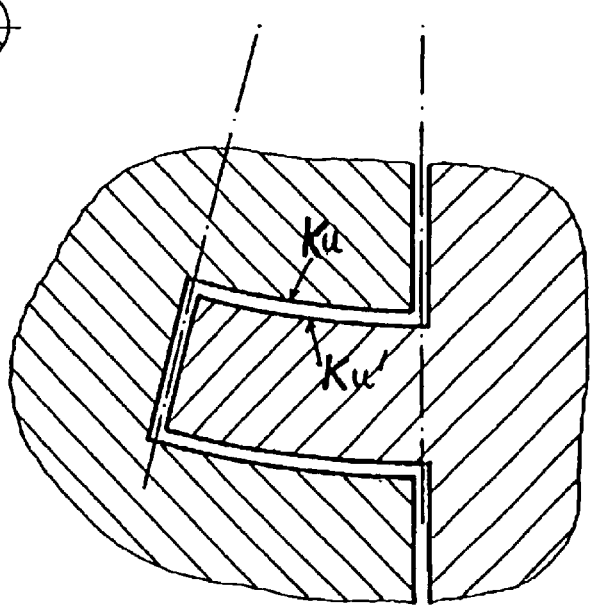
FIG. 23 is a partial view, in a section through the axis, of a section of the internal rotor and of the parts of the external rotor surrounding it, of an eighth embodiment.

The gaps between front areas of two sections which slide over each other are gaps between two spherical areas (Ku, Ku'), as shown in FIG. 23. The large gap lengths, along the direction of flow, provide a good seal with this embodiment as well, and a good end vacuum.

An internal compression occurs through the variation in the rotor diameter and can be amplified or reduced by additional variation in the thicknesses of the profile sections, and modulated locally if necessary, depending on the use of the displacement or vacuum pump. This construction is very compact, with few components and good heat evacuation. The synchronising device can be realised as a simple, lubricant-free coupling mechanism, for example as a universal joint, inside the displacement machine, respectively vacuum pump.

What is claimed is:

1. Rotary piston machine for compressible media, with at least two rotary pistons sealed in a common housing, rotatable with one another in a controlled manner, the two rotary pistons having a plurality of disk-shaped sections which engage in one another in pairs, whose thickness and/or diameter decreases in the direction of the pressure side, each disk having at least one surface area and one core area formed by directrices drawn along arcs of circles with the centre on the axis of the respective rotary piston and respectively connected by an interface area, characterised in that the sector angle of the surface area and of the core area of a respective disk are not identical, that the disks have various transverse profile contours recurring periodically along the piston axis and that each disk is offset at an angle to the two adjacent disks of the same piston in such a way that these three disks have a common directrix via one section of their core areas and form a chamber.

2. Rotary piston machine according to claim 1, characterised in that both adjacent disks of a disk with a surface area, whose sector angle is greater than the sector angle of the core area, have surface areas whose sector angles are smaller than the sector angles of the core areas.

3. Rotary piston machine according to claim 2, characterised in that the interface areas of a disk respectively form with an interface area of an adjacent disk a continuous interface area with common directrix.

4. Rotary piston machine according to claim 1, characterised in that the two rotary pistons are accommodated extra-axially and with parallel axes, that the said disks have external surface areas and internal core areas, which are formed by the directrices of respectively one outer cylinder and one core cylinder, and that the thickness of the disk-shaped sections decreases in the direction of the pressure side.

5. Rotary piston machine according to claim 4, characterised in that the synchronising device is developed so as to confer a contrarotating direction of rotation on the two rotary pistons.

6. Rotary piston machine according to claim 5, characterised in that the diameters of the external surface areas and core areas of the two rotary pistons respectively are identical.

7. Rotary piston machine according to claim 6, characterised in that the sector angle of the external surface area of each second disk of a rotary piston is smaller than 90°, in particular smaller than 60°.

8. Rotary piston machine according to claim 7, characterised in that the thickness of the disks in the direction of the pressure side decreases every two disks by a constant factor.

9. Rotary piston machine according to claim 4, characterised in that the rotary pistons have various external diameters and that the thickness of the sections of the main rotor, which have an external surface area with small sector angle is respectively larger than the thickness of the sections of the main rotor with surface areas with large sector angle.

10. Rotary piston machine according to claim 9, characterised in that the diameter of the core area of the main rotor is identical to the diameter of the external surface area of the auxiliary rotor.

11. Rotary piston machine according to claim 9, characterised in that each disk of the main rotor respectively has two diametrically opposed core areas and two external, diametrically opposed surface areas, and that the speed of rotation of the auxiliary rotor is the same as double the speed of the main rotor.

12. Rotary piston machine according claim 9, characterised in that the sequences of periodically recurring transverse profile contours include disks consisting only of the core cylinder and/or locking disks.

13. Rotary piston machine according to claim 4, characterised in that the synchronising device is developed so as to confer the same direction of rotation upon the rotary pistons, that the rotary pistons have different external diameters and that the thickness of the sections of the main rotor, which have an external surface area with small sector angle is respectively larger than the thickness of the sections of the main rotor with surface areas with large sector angle.

14. Rotary piston machine according to claim 1, characterised by inner-axially supported rotary pistons, namely an external rotor, an internal rotor and a G rotor, the external rotor and the internal rotor having a plurality of disk-shaped sections engaging in one another in pairs, whose thickness and/or diameter decreases in the direction of the pressure side, each disk of the external and of the internal rotor having at least one surface area and one core area, formed by directrices drawn along arcs of circles with the centre on the axis of the respective rotor, and connected respectively by an interface area, the sector angles of the surface area and of the core area of a respective disk being not identical, the disks having various transverse profile contours recurring periodically along the rotor axis and each disk being offset at an angle to the two adjacent disks of the same rotor in such a way that these three disks have a common directrix via a section and form a chamber.

15. Rotary piston machine according to claim 14, characterised in that the synchronising device is developed so as to confer the same direction of rotation upon the rotors, with a translation of 1:1.

16. Rotary piston machine according to claim 14, characterised in that both adjacent disks of a disk with a surface area whose sector angle is greater than the sector angle of the core area, have surface areas whose sector angles are smaller than the sector angle of the core areas.

17. Rotary piston machine according to claim 16, characterised in that the interface areas of a disk form respectively with an interface of an adjacent disk a continuous interface area with common directrix.

18. Rotary piston machine according to claim 14, characterised in that the rotors are accommodated with parallel axes, the said directrices are cylindrical directrices and the thickness of the sections decreases in the direction of the pressure side.

19. Rotary piston machine according to claim 14, characterised in that the axes of the rotors are arranged as oblique axes, the said directrices are conical directrices and the diameters of the rotor sections decrease in the direction of the pressure side, wherein the sections of the external rotor and of the internal rotor are ball cup-shaped instead of disk-shaped.

* * * * *